US010957525B2

(12) United States Patent
Green et al.

(10) Patent No.: US 10,957,525 B2
(45) Date of Patent: Mar. 23, 2021

(54) TRAP FILL TIME DYNAMIC RANGE ENHANCEMENT

(71) Applicant: Micromass UK Limited, Wilmslow (GB)

(72) Inventors: Martin Raymond Green, Bowdon (GB); Jason Lee Wildgoose, Heaton Mersey (GB); Steven Derek Pringle, Darwen (GB); Kevin R. Howes, Altrincham (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 16/726,519

(22) Filed: Dec. 24, 2019

(65) Prior Publication Data

US 2020/0144041 A1 May 7, 2020

Related U.S. Application Data

(63) Continuation of application No. 15/574,116, filed as application No. PCT/GB2016/051395 on May 13, 2016, now Pat. No. 10,522,336.

(30) Foreign Application Priority Data

May 14, 2015 (GB) ..... 1508197

(51) Int. Cl.

| | |
|---|---|
| ***H01J 49/02*** | (2006.01) |
| ***H01J 49/42*** | (2006.01) |
| ***H01J 49/00*** | (2006.01) |

(52) U.S. Cl.
CPC ..... *H01J 49/025* (2013.01); *H01J 49/0031* (2013.01); *H01J 49/0036* (2013.01); *H01J 49/4265* (2013.01)

(58) Field of Classification Search
CPC .. H01J 49/025; H01J 49/0031; H01J 49/0036; H01J 49/4265
See application file for complete search history.

(56) References Cited

U.S. PATENT DOCUMENTS 7,838,826 B1 11/2010 Park
7,847,248 B2 * 12/2010 Collings ..... H01J 49/4265 250/292

(Continued)

*Primary Examiner* — David E Smith
(74) *Attorney, Agent, or Firm* — Kacvinsky Daisak Bluni PLLC

(57) ABSTRACT

A method of mass and/or ion mobility spectrometry is disclosed that comprises accumulating ions for a first period of time (T1) one or more times so as to form one or more first groups of ions, accumulating ions for a second period of time (T2) one or more times so as to form one or more second groups of ions, wherein the second period of time (T2) is less that the first period of time (T1), analysing the one or more first groups of ions to generate one or more first data sets, analysing the one or more second groups of ions to generate one or more second data sets, and determining whether the one or more first data sets comprise saturated and/or distorted data. If it is determined that the one or more first data sets comprise saturated and/or distorted data, then the method further comprises replacing the saturated and/or distorted data from the one or more first data sets with corresponding data from the one or more second data sets.

18 Claims, 9 Drawing Sheets

(56) References Cited

U.S. PATENT DOCUMENTS

| | | | | |
|---|---|---|---|---|
| 8,653,446 | B1 * | 2/2014 | Mordehai | H01J 49/40 250/281 |
| 2004/0021070 | A1 * | 2/2004 | Bateman | H01J 49/0081 250/288 |
| 2004/0084613 | A1 * | 5/2004 | Bateman | H01J 49/0027 250/281 |

* cited by examiner

TRAP FILL TIME DYNAMIC RANGE ENHANCEMENT

CROSS-REFERENCE TO RELATED APPLICATIONS

This application is a continuation of U.S. patent application Ser. No. 15/574,116, filed Nov. 14, 2017, which is a national stage application claiming the benefit of and priority to International Application No. PCT/GB2016/051395, filed May 13, 2016, which claims priority from and the benefit of United Kingdom patent application No. 1508197.9 filed on May 14, 2015. The entire contents of these applications are incorporated herein by reference.

FIELD OF THE INVENTION

The present invention relates generally to mass and/or ion mobility spectrometry and in particular to mass and/or ion mobility spectrometers and methods of mass and/or ion mobility spectrometry.

BACKGROUND

It is known to extend the dynamic range of an orthogonal Time of Flight mass spectrometer using a method of transmission switching. A primary continuous ion beam is repeatedly switched between a high transmission mode and a low transmission mode by attenuating the beam. Mass spectra are consecutively and repeatedly acquired during the high and low transmission modes.

Individual mass spectral peaks in the high transmission mode spectra which are distorted due to exceeding the dynamic range of the detection system are replaced by corresponding data from the low transmission mode spectra (scaled by a suitable factor) in which detector saturation has not occurred. The composite spectrum produced in this way has an increased dynamic range.

U.S. Pat. No. 7,683,314 (Micromass) discloses a technique in which a continuous ion beam is attenuated in a low transmission mode by rapidly gating the beam ON and OFF using a periodic gating electrode so as to form discontinuous beam of ions.

However, this technique is relatively complex since, for example, it is necessary to form a continuous or semi-continuous beam of ions from the discontinuous beam of ions before presenting it to the orthogonal acceleration Time of Flight mass spectrometer so that the flux or density of ions sampled into the flight tube of the mass spectrometer during an orthogonal acceleration will be reduced in the low transmission mode. This is achieved by passing the discontinuous beam through a downstream gas filled region of the mass spectrometer such that the discontinuous beam is merged into a continuous or semi-continuous beam. The periodic gating typically has a cycle time of less than 1 ms so that the discontinuous beam can be efficiently merged into a continuous or semi-continuous beam in the high pressure region.

U.S. Pat. No. 7,038,197 (Micromass) discloses a technique in which a defocusing lens element is used to reduce the transmission of an ion beam. Although this results in a continuous ion beam as desired, it can also result in undesirable mass and/or charge discrimination so that complex calibration is required.

It is therefore desired to provide an improved method of mass and/or ion mobility spectrometry.

SUMMARY

According to an aspect there is provided a method of mass and/or ion mobility spectrometry comprising:

accumulating ions for a first period of time one or more times so as to form one or more first groups of ions;

accumulating ions for a second period of time one or more times so as to form one or more second groups of ions, wherein the second period of time is less that the first period of time;

analysing the one or more first groups of ions to generate one or more first data sets;

analysing the one or more second groups of ions to generate one or more second data sets; and determining whether the one or more first data sets comprise saturated and/or distorted data;

wherein if it is determined that the one or more first data sets comprise saturated and/or distorted data, then the method further comprises:

replacing the saturated and/or distorted data from the one or more first data sets with corresponding data from the one or more second data sets.

Various embodiments relate to a method that uses two or more different ion accumulation times to generate "high" and "low intensity" data. One or more first groups of ions may be formed by, for each of the first groups of ions, accumulating ions for a first period of time in an accumulation region, and one or more second groups of ions may be formed by, for each of the second groups of ions, accumulating ions for a second, shorter period of time in an accumulation region. The first and second groups of ions may be analysed so as to generate first and second data sets, and any saturated and/or distorted data in the first data set may be replaced by corresponding data from the second data set.

Thus, according to various embodiments, the filling time of an accumulation region may be altered to reduce the number of ions transmitted to the detector, rather than reducing the transmission of a continuous (non-trapped) ion beam. Since there is no requirement to produce a low transmission continuous ion beam in accordance with various embodiments, the complexities of the known techniques, such as the necessity of forming a continuous or semi-continuous beam of ions from a discontinuous beam of ions, and/or the mass to charge ratio discrimination problem that can be encountered when using a simple defocusing lens to reduce the transmission of the ion beam, can beneficially be avoided.

Furthermore, according to various embodiments, the amount of time for which ions are allowed to enter an accumulation region can be controlled precisely (e.g. using an electrode) so that the number of ions in the high and low transmission modes can be very precisely controlled. The trapping and release of ions according to various embodiments can also be synchronised with one or more downstream devices (e.g. such as an ion mobility separator).

It will accordingly be appreciated that various embodiments represent a simple and effective technique for enhancing the dynamic range of a mass and/or ion mobility spectrometer.

The method may comprise generating ions;

wherein the step of accumulating ions for the first period of time may comprise accumulating the generated ions for the first period of time; and wherein the step of accumulating ions for the second period of time may comprise accumulating the generated ions for the second period of time.

The step of generating the ions may comprise generating a substantially continuous beam of the ions.

The step of generating the ions may comprise ionising a sample to generate the ions; and/or ionising a sample to generate parent or precursor ions and then fragmenting or reacting the parent or precursor ions to generate the ions.

The method may comprise accumulating the ions so as to form one or more of the one or more first and/or second groups of ions and at the same time analysing one or more (other) of the one or more first and/or second groups of ions. This has the effect of increasing the duty cycle.

The method may comprise accumulating the ions so as to form a particular first and/or second group of ions; and accumulating the ions so as to form another first and/or second group of ions and at the same time analysing the particular first and/or second group of ions.

Each of the one or more second groups of ions may comprise fewer ions than each of the one or more first groups of ions.

In a given period of time the method may comprise forming n of the first groups of ions; and forming m of the second groups of ions; wherein n is greater than or equal to m.

n may be greater than m. This has the effect of increasing the duty cycle.

n and m may be positive integers. n and/or m may be greater than 1.

The method may comprise forming relatively more of the first groups of ions than the second groups of ions in a given period of time.

The method may comprise forming plural first groups of ions and/or forming plural second groups of ions in the given period of time.

The method may comprise on average forming relatively more first groups of ions than second groups of ions.

The step of accumulating ions for the first period of time one or more times may comprise repeatedly accumulating ions for the first period of time so as to form a plurality of first groups of ions; and/or the step of accumulating ions for the second period of time one or more times may comprise repeatedly accumulating ions for the second period of time so as to form a plurality of second groups of ions.

The method may comprise repeatedly switching between the step of accumulating ions for the first period of time and the step of accumulating ions for the second period of time.

The rate at which alternate first and second groups of ions are accumulated and analysed may be such that the composition of consecutive first and second groups of ions are substantially the same.

The method may comprise accumulating the ions so as to form one or more of the one or more first and/or second groups of ions and at the same time separating according to one or more first physico-chemical properties one or more (other) of the one or more first and/or second groups of ions. This has the effect of increasing the duty cycle.

The method may comprise accumulating the ions so as to form a particular first and/or second group of ions; and accumulating the ions so as to form another first and/or second group of ions and at the same time separating according to one or more first physico-chemical properties the particular first and/or second group of ions.

The method may comprise separating the one or more first groups of ions and/or the one or more second groups of ions according to one or more first physico-chemical properties before the step of analysing the one or more first groups of ions and/or the one or more second groups of ions.

The step of separating ions according to the one or more first physico-chemical properties may comprise operating a separation device in a cyclical manner so as to repeatedly separate groups of ions according to the one or more first physico-chemical properties; and the steps of accumulating and analysing the ions may be performed repeatedly in synchronism with the cycle time of the separation device.

The one or more first physico-chemical properties may comprise ion mobility and/or mass to charge ratio.

The one or more first physico-chemical properties may comprise ion mobility and/or collision cross section and/or interaction cross section and/or mass to charge ratio.

The step of separating the one or more first groups of ions and/or the one or more second groups of ions according to the one or more first physico-chemical properties may comprise separating the one or more first groups of ions and/or the one or more second groups of ions during a third period of time.

The third period of time may be greater than the second period of time; and/or the third period of time may be greater than or equal to the first period of time; and/or the third period of time may be concurrent with the first and/or second period of time.

Ions may be separated according to mass to charge ratio using an analytical ion trap or other mass to charge ratio separator.

The method may comprise accumulating the ions so as to form one or more of the one or more first and/or second groups of ions and at the same time filtering according to one or more second physico-chemical properties one or more (other) of the one or more first and/or second groups of ions. This has the effect of increasing the duty cycle.

The method may comprise accumulating the ions so as to form a particular first and/or second group of ions; and accumulating the ions so as to form another first and/or second group of ions and at the same time filtering according to one or more second physico-chemical properties the particular first and/or second group of ions.

The method may comprise filtering the one or more first groups of ions and/or the one or more second groups of ions according to one or more second physico-chemical properties before the step of analysing the one or more first groups of ions and/or the one or more second groups of ions.

The one or more second physico-chemical properties may comprise ion mobility and/or mass to charge ratio and/or collision cross section.

The one or more second physico-chemical properties may comprise ion mobility and/or collision cross section and/or interaction cross section and/or mass to charge ratio.

Ions may be filtered according to mass to charge ratio using a quadrupole mass filter or other mass to charge ratio filter.

The step of accumulating ions may comprise accumulating the ions in an ion trap or accumulation region.

The ion trap or accumulation region may comprise a mass-selective ion trap or a non-mass-selective ion trap.

The method may comprise ejecting the one or more first groups of ions and/or the one or more second groups of ions from the ion trap or accumulation region before the step(s) of separating, filtering and/or analysing the one or more first groups of ions and/or the one or more second groups of ions.

The step of ejecting the one or more first groups of ions and/or the one or more second groups of ions from the ion trap or accumulation region may comprise ejecting the one or more first groups of ions and/or the one or more second groups of ions from the ion trap or accumulation region during a fourth period of time.

The fourth period of time may immediately follow and/or precede the first period of time and/or the second period of time and/or the third period of time.

The step of analysing the one or more first groups of ions and/or the one or more second groups of ions may comprise:

determining the mass to charge ratio of the one or more first groups of ions and/or the one or more second groups of ions; and/or determining the ion mobility, collision cross section and/or interaction cross section of the one or more first groups of ions and/or the one or more second groups of ions.

The step of determining the mass to charge ratio of the one or more first groups of ions and/or the one or more second groups of ions may comprise separating the ions according to their mass to charge ratio.

The step of determining the ion mobility, collision cross section and/or interaction cross section of the one or more first groups of ions and/or the one or more second groups of ions may comprise separating the ions according to their ion mobility, collision cross section and/or interaction cross section.

The step of analysing the one or more first groups of ions and/or the one or more second groups of ions may comprise determining the mass to charge ratio of the one or more first groups of ions and/or the one or more second groups of ions using a Time of Flight mass analyser.

The step of determining whether the one or more first data sets comprises saturated and/or distorted data may comprise:

determining whether the one or more first data sets comprises data having a value greater than or equal to a detector saturation level; and/or determining whether the one or more first data sets comprises distorted data resulting from space charge effects.

The step of replacing the saturated and/or distorted data from the one or more first data sets with the corresponding data from the one or more second data sets may comprise:

replacing one or more saturated and/or distorted data values or peaks from the one or more first data sets with one or more corresponding data values or peaks from the one or more second data sets; and/or replacing one or more of the one or more first data sets with one or more of the one or more second data sets.

The step of replacing the saturated and/or distorted data from the one or more first data sets with the corresponding data from the one or more second data sets may comprise:

scaling the corresponding data from the one or more second data sets; and replacing the saturated and/or distorted data from the one or more first data sets with the scaled data from the one or more second data sets.

The step of determining whether the one or more first data sets comprises saturated and/or distorted data may comprise comparing data from the one or more first data sets with data from the one or more second data sets.

According to another aspect there is provided a method of mass and/or ion mobility spectrometry comprising:

analysing one or more first groups of ions to generate one or more first data sets;

analysing one or more second groups of ions to generate one or more second data sets, wherein each of the one or more second groups of ions comprises fewer ions than each of the one or more first groups of ions;

determining whether the one or more first data sets comprises saturated and/or distorted data by comparing data from the one or more first data sets with data from the one or more second data sets;

wherein if it is determined that the one or more first data sets comprise saturated and/or distorted data, then the method further comprises:

replacing the saturated and/or distorted data from the one or more first data sets with corresponding data from the one or more second data sets.

The method may comprise:

forming the one or more first groups of ions by, for each of the one or more first groups of ions, accumulating ions for a first period of time; and forming the one or more second groups of ions by, for each of the one or more second groups of ions, accumulating ions for a second period of time, wherein the second period of time is less that the first period of time.

The method may comprise:

passing ions through one or more first devices;

forming the one or more first groups of ions by operating one or more of the one or more first devices in a high transmission mode of operation; and forming the one or more second groups of ions by operating one or more of the one or more first devices in a low transmission mode of operation.

The one or more first devices may be selected from the group consisting of: (i) one or more ion gating devices; (ii) one or more electrodes; and (iii) one or more ion lenses.

The step of determining whether the one or more first data sets comprises saturated and/or distorted data by comparing data from the one or more first data sets with data from the one or more second data sets may comprise determining whether the data from the one or more first data sets differs from the data from the one or more second data sets in an unexpected manner.

The step of determining whether the one or more first data sets comprises saturated and/or distorted data by comparing the data from the one or more first data sets with the data from the one or more second data sets may comprise determining whether the data from the one or more first data sets differs from the data from the one or more second data sets in a manner other than by an expected intensity scaling factor.

The expected intensity scaling factor may approximately correspond to the ratio between the number of ions in one or more of the one or more first groups of ions to the number of ions in one or more of the one or more second groups of ions.

The step of determining whether the one or more first data sets comprises saturated and/or distorted data by comparing the data from the one or more first data sets with the data from the one or more second data sets may comprise determining whether the data from the one or more first data sets differs from the data from the one or more second data sets in terms of: (i) one or more masses or mass to charge ratios; (ii) one or more ion mobilities, ion mobility drift times, collision cross sections or interaction cross sections; (iii) an intensity ratio or difference between two or more isotope or other ion peaks within a data set; and/or (iv) an unexpected intensity scaling factor.

The step of comparing data from the one or more first data sets with data from the one or more second data sets may comprise comparing data from the one or more first data sets with corresponding data from the one or more second data sets.

According to another aspect there is provided a mass and/or ion mobility spectrometer comprising:

a device arranged and adapted to accumulate ions for a first period of time one or more times so as to form one or more first groups of ions;

a device arranged and adapted to accumulate ions for a second period of time one or more times so as to form one or more second groups of ions, wherein the second period of time is less that the first period of time;

an analyser arranged and adapted to analyse the one or more first groups of ions to generate one or more first data sets and to analyse the one or more second groups of ions to generate one or more second data sets; and a control system, control circuitry and/or processing circuitry arranged and adapted to determine whether the one or more first data sets comprise saturated and/or distorted data;

wherein the control system, control circuitry and/or processing circuitry is further arranged and adapted, if it is determined that the one or more first data sets comprise saturated and/or distorted data, to:

replace the saturated and/or distorted data from the one or more first data sets with corresponding data from the one or more second data sets.

The spectrometer may comprise an ion source for generating the ions.

The ion source may be operable to generate a substantially continuous beam of the ions.

The spectrometer may comprise a collision, reaction or fragmentation device for generating the ions.

The spectrometer may be configured to accumulate the ions so as to form one or more of the one or more first and/or second groups of ions at the same time as analysing one or more (other) of the one or more first and/or second groups of ions.

The spectrometer may be configured to accumulate the ions so as to form a particular first and/or second group of ions; and to accumulate the ions so as to form another first and/or second group of ions at the same time as analysing the particular first and/or second group of ions.

Each of the one or more second groups of ions may comprise fewer ions than each of the one or more first groups of ions.

The spectrometer may be configured to form n of the first groups of ions and m of the second groups of ions, wherein n is greater than or equal to m, in a given period of time.

n may be greater than m. n and m may be positive integers. n and/or m may be greater than 1.

The spectrometer may be configured to form relatively more of the first groups of ions than the second groups of ions in a given period of time.

The spectrometer may be configured to form plural first groups of ions and/or plural second groups of ions in the given period of time.

The spectrometer may be configured to form on average relatively more of the first groups of ions than the second groups of ions.

The spectrometer may be configured to repeatedly accumulate ions for the first period of time so as to form a plurality of first groups of ions; and/or to repeatedly accumulate ions for the second period of time so as to form a plurality of second groups of ions.

The spectrometer may be configured to repeatedly switch between accumulating ions for the first period of time and accumulating ions for the second period of time.

The rate at which alternate first and second groups of ions are accumulated and analysed may be such that the composition of consecutive first and second groups of ions are substantially the same.

The spectrometer may be configured to accumulate the ions so as to form one or more of the one or more first and/or second groups of ions at the same time as separating according to one or more first physico-chemical properties one or more (other) of the one or more first and/or second groups of ions.

The spectrometer may be configured to accumulate the ions so as to form a particular first and/or second group of ions; and accumulate the ions so as to form another first and/or second group of ions at the same time as separating according to one or more first physico-chemical properties the particular first and/or second group of ions.

The spectrometer may be configured to separate the one or more first groups of ions and/or the one or more second groups of ions according to one or more first physico-chemical properties before analysing the one or more first groups of ions and/or the one or more second groups of ions.

The spectrometer may be configured to separate ions according to the one or more first physico-chemical properties by operating a separation device in a cyclical manner so as to repeatedly separate groups of ions according to the one or more first physico-chemical properties; and the spectrometer may be configured to accumulate and analyse the ions repeatedly in synchronism with the cycle time of the separation device.

The one or more first physico-chemical properties may comprise ion mobility and/or mass to charge ratio.

The one or more first physico-chemical properties may comprise ion mobility and/or collision cross section and/or interaction cross section and/or mass to charge ratio.

The spectrometer may comprise an analytical ion trap or other mass to charge ratio separator for separating ions according to their mass to charge ratio.

The spectrometer may be configured to separate the one or more first groups of ions and/or the one or more second groups of ions during a third period of time.

The third period of time may be greater than the second period of time; and/or the third period of time may be greater than or equal to the first period of time; and/or the third period of time may be concurrent with the first and/or second period of time.

The spectrometer may be configured to accumulate the ions so as to form one or more of the one or more first and/or second groups of ions at the same time as filtering according to one or more second physico-chemical properties one or more (other) of the one or more first and/or second groups of ions.

The spectrometer may be configured to accumulate the ions so as to form a particular first and/or second group of ions; and accumulate the ions so as to form another first and/or second group of ions at the same time as filtering according to one or more second physico-chemical properties the particular first and/or second group of ions.

The spectrometer may be configured to filter the one or more first groups of ions and/or the one or more second groups of ions according to one or more second physico-chemical properties before analysing the one or more first groups of ions and/or the one or more second groups of ions.

The one or more second physico-chemical properties may comprise ion mobility and/or mass to charge ratio and/or collision cross section.

The one or more second physico-chemical properties may comprise ion mobility and/or collision cross section and/or interaction cross section and/or mass to charge ratio.

The spectrometer may comprise a quadrupole mass filter or other mass to charge ratio filter for filtering ions according to their mass to charge ratio.

The spectrometer and/or the device may comprise an ion trap or accumulation region for accumulating the ions.

The ion trap or accumulation region may comprise a mass-selective ion trap or a non-mass-selective ion trap.

The spectrometer may be configured to eject the one or more first groups of ions and/or the one or more second groups of ions from the ion trap or accumulation region before separating, filtering and/or analysing the one or more first groups of ions and/or the one or more second groups of ions.

The spectrometer may be configured to eject the one or more first groups of ions and/or the one or more second groups of ions from the ion trap or accumulation region during a fourth period of time.

The fourth period of time may immediately follow and/or precede the first period of time and/or the second period of time and/or the third period of time.

The spectrometer and/or analyser may be configured to determine the mass to charge ratio of the one or more first groups of ions and/or the one or more second groups of ions; and/or determine the ion mobility, collision cross section and/or interaction cross section of the one or more first groups of ions and/or the one or more second groups of ions.

The spectrometer and/or analyser may be configured to determine the mass to charge ratio of the one or more first groups of ions and/or the one or more second groups of ions by separating the ions according to their mass to charge ratio.

The spectrometer and/or analyser may be configured to determine the ion mobility, collision cross section and/or interaction cross section of the one or more first groups of ions and/or the one or more second groups of ions by separating the ions according to their ion mobility, collision cross section and/or interaction cross section.

The spectrometer and/or analyser may comprise a Time of Flight mass analyser for determining the mass to charge ratio of the ions.

The spectrometer, control system, control circuitry and/or processing circuitry may be configured to determine whether the one or more first data sets comprises saturated and/or distorted data by:

determining whether the one or more first data sets comprises data having a value greater than or equal to a detector saturation level; and/or determining whether the one or more first data sets comprises distorted data resulting from space charge effects.

The spectrometer, control system, control circuitry and/or processing circuitry may be configured to replace the saturated and/or distorted data from the one or more first data sets with the corresponding data from the one or more second data sets by:

replacing one or more saturated and/or distorted data values or peaks from the one or more first data sets with one or more corresponding data values or peaks from the one or more second data sets; and/or replacing one or more of the one or more first data sets with one or more of the one or more second data sets.

The spectrometer, control system, control circuitry and/or processing circuitry may be configured to replace the saturated and/or distorted data from the one or more first data sets with the corresponding data from the one or more second data sets by:

scaling the corresponding data from the one or more second data sets; and replacing the saturated and/or distorted data from the one or more first data sets with the scaled data from the one or more second data sets.

The spectrometer, control system, control circuitry and/or processing circuitry may be configured to determine whether the one or more first data sets comprises saturated and/or distorted data by comparing data from the one or more first data sets with data from the one or more second data sets.

According to another aspect there is provided a mass and/or ion mobility spectrometer comprising:

an analyser arranged and adapted to analyse one or more first groups of ions to generate one or more first data sets and to analyse one or more second groups of ions to generate one or more second data sets, wherein each of the one or more second groups of ions comprises fewer ions than each of the one or more first groups of ions; and a control system, control circuitry and/or processing circuitry arranged and adapted to determine whether the one or more first data sets comprise saturated and/or distorted data by comparing the one or more first data sets with the one or more second data sets;

wherein the control system, control circuitry and/or processing circuitry is further arranged and adapted, if it is determined that the one or more first data sets comprise saturated and/or distorted data, to:

replace the saturated and/or distorted data from the one or more first data sets with corresponding data from the one or more second data sets.

The spectrometer may comprise one or more devices configured to form the one or more first groups of ions by, for each of the one or more first groups of ions, accumulating ions for a first period of time; and to form the one or more second groups of ions by, for each of the one or more second groups of ions, accumulating ions for a second period of time, wherein the second period of time is less that the first period of time.

The spectrometer may comprise one or more first devices, and the spectrometer may be configured to:

form the one or more first groups of ions by operating one or more of the one or more first devices in a high transmission mode of operation; and form the one or more second groups of ions by operating one or more of the one or more first devices in a low transmission mode of operation.

The one or more first devices may be selected from the group consisting of: (i) one or more ion gating devices; (ii) one or more electrodes; and (iii) one or more ion lenses.

The spectrometer, control system, control circuitry and/or processing circuitry may be configured to determine whether the one or more first data sets comprises saturated and/or distorted data by determining whether the data from the one or more first data sets differs from the data from the one or more second data sets in an unexpected manner.

The spectrometer, control system, control circuitry and/or processing circuitry may be configured to determine whether the one or more first data sets comprises saturated and/or distorted data by determining whether the data from the one or more first data sets differs from the data from the one or more second data sets in a manner other than by an expected intensity scaling factor.

The expected intensity scaling factor may approximately correspond to the ratio between the number of ions in one or more of the one or more first groups of ions to the number of ions in one or more of the one or more second groups of ions.

The spectrometer, control system, control circuitry and/or processing circuitry may be configured to determine whether the one or more first data sets comprises saturated and/or distorted data by determining whether the data from the one or more first data sets differs from the data from the one or more second data sets in terms of: (i) one or more masses or mass to charge ratios; (ii) one or more ion mobilities, ion mobility drift times, collision cross section or interaction cross sections; (iii) an intensity ratio or difference between two or more isotope or other ion peaks in a data set; and/or (iv) an unexpected intensity scaling factor.

The spectrometer, control system, control circuitry and/or processing circuitry may be configured to compare data from the one or more first data sets with data from the one or more second data sets by comparing data from the one or more first data sets with corresponding data from the one or more second data sets.

According to an aspect there is provided a method of mass and/or ion mobility spectrometry comprising:

providing an ion source, an ion trapping region downstream of the ion source, an ion mobility separation device downstream of the trapping region, and a Time of Flight mass analyser downstream of the ion mobility separation device;

repeatedly switching between a first mode of operation in which the time in which a population of ion are allowed to enter the ion trapping region prior to a first ion mobility separation or set of ion mobility separations is a first fixed time, and a second mode of operation in which the time in which ions are allowed to enter the trapping region prior to a second ion mobility separation or set of ion mobility separations is a second fixed time, wherein the first time is substantially longer than the second time;

obtaining first ion mobility and/or mass spectral data during the first mode of operation, and second ion mobility and/or mass spectral data during the second mode of operation; and using at least some of the second ion mobility and/or mass spectral data instead of at least some of the first ion mobility and/or mass spectral data if it is determined that at least some of the data has been affected by saturation or distortion.

According to an aspect there is provided a method of mass and/or ion mobility spectrometry comprising:

forming a plurality of initial groups of ions by repeatedly accumulating groups of ions;

forming one or more first groups of ions from one or more of the initial groups of ions;

forming one or more second groups of ions by extracting or separating ions from one or more of the initial groups of ions, wherein each of the one or more second groups of ions comprises fewer ions than each of the one or more first groups of ions;

analysing the one or more first groups of ions to generate one or more first data sets;

analysing the one or more second groups of ions to generate one or more second data sets; and determining whether the one or more first data sets comprise saturated and/or distorted data;

wherein when it is determined that the one or more first data sets comprise saturated and/or distorted data, then the method further comprises:

replacing the saturated and/or distorted data from the one or more first data sets with corresponding data from the one or more second data sets.

According to an aspect there is provided a mass and/or ion mobility spectrometer comprising:

a device configured to form a plurality of initial groups of ions by repeatedly accumulating groups of ions;

a device configured to form one or more first groups of ions from one or more of the initial groups of ions;

a device configured to form one or more second groups of ions by extracting or separating ions from one or more of the initial groups of ions, wherein each of the one or more second groups of ions comprises fewer ions than each of the one or more first groups of ions;

an analyser configured to analyse the one or more first groups of ions to generate one or more first data sets and to analyse the one or more second groups of ions to generate one or more second data sets; and a control system configured to determine whether the one or more first data sets comprise saturated and/or distorted data;

wherein the control system is further configured to, when it is determined that the one or more first data sets comprise saturated and/or distorted data:

replace the saturated and/or distorted data from the one or more first data sets with corresponding data from the one or more second data sets.

Forming each second group of ions may comprise extracting or separating a portion (less than all) of the ions from an initial group of ions.

Forming each of the one or more second groups of ions may comprise (spatially) separating or isolating the second group of ions from an initial group of ions within an ion trap, trapping region or accumulation region.

Forming each of the one or more second groups of ions may comprise passing to a downstream device only the second group of ions from an initial group of ions within an ion trap, trapping region or accumulation region.

Forming each of the one or more second groups of ions may comprise ejecting only the second group of ions from the initial group of ions within the ion trap, trapping region or accumulation region.

The plurality of initial groups of ions may be formed by repeatedly accumulating ions for a fixed period of time.

The plurality of initial groups of ions may be formed by repeatedly accumulating ions for a constant period of time.

The step of forming a plurality of initial groups of ions may comprise:

accumulating ions for a first period of time one or more times so as to form one or more first initial groups of ions; and accumulating ions for a second period of time one or more times so as to form one or more second initial groups of ions, wherein the second period of time is less that the first period of time.

The one or more first groups of ions may be formed from the one or more first initial groups of ions; and/or the one or more second groups of ions may be formed from the one or more second initial groups of ions.

The spectrometer may comprise an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MATT") ion source; (xxvi) a Solvent Assisted Inlet Ionisation ("SAII") ion source; (xxvii) a Desorption Electrospray Ionisation ("DESI") ion source; (xxviii) a Laser Ablation Electrospray Ionisation ("LAESI") ion source; and (xxix) Surface Assisted Laser Desorption Ionisation ("SALDI").

The spectrometer may comprise one or more continuous or pulsed ion sources.

The spectrometer may comprise one or more ion guides.

The spectrometer may comprise one or more ion mobility separation devices and/or one or more Field Asymmetric Ion Mobility Spectrometer devices.

The spectrometer may comprise one or more ion traps or one or more ion trapping regions.

The spectrometer may comprise one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The spectrometer may comprise a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

The spectrometer may comprise one or more energy analysers or electrostatic energy analysers.

The spectrometer may comprise one or more ion detectors.

The spectrometer may comprise one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter.

The spectrometer may comprise a device or ion gate for pulsing ions; and/or a device for converting a substantially continuous ion beam into a pulsed ion beam.

The spectrometer may comprise a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser.

The spectrometer may comprise a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer may comprise a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5

MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The spectrometer may comprise a chromatography or other separation device upstream of an ion source. The chromatography separation device may comprise a liquid chromatography or gas chromatography device. Alternatively, the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) >about 1000 mbar.

Analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

Optionally, in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) C60 vapour or atoms; and (viii) magnesium vapour or atoms.

The multiply charged analyte cations or positively charged ions may comprise peptides, polypeptides, proteins or biomolecules.

Optionally, in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenyl-anthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

The process of Electron Transfer Dissociation fragmentation may comprise interacting analyte ions with reagent ions, wherein the reagent ions comprise dicyanobenzene, 4-nitrotoluene or azulene.

A chromatography detector may be provided, wherein the chromatography detector comprises either:

a destructive chromatography detector optionally selected from the group consisting of (i) a Flame Ionization Detector (FID); (ii) an aerosol-based detector or Nano Quantity Analyte Detector (NQAD); (iii) a Flame Photometric Detector (FPD); (iv) an Atomic-Emission Detector (AED); (v) a Nitrogen Phosphorus Detector (NPD); and (vi) an Evaporative Light Scattering Detector (ELSD); or a non-destructive chromatography detector optionally selected from the group consisting of: (i) a fixed or variable wavelength UV detector; (ii) a Thermal Conductivity Detector (TCD); (iii) a fluorescence detector; (iv) an Electron Capture Detector (ECD); (v) a conductivity monitor; (vi) a Photoionization Detector (PID); (vii) a Refractive Index Detector (RID); (viii) a radio flow detector; and (ix) a chiral detector.

The spectrometer may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation a Quantification mode of operation or an Ion Mobility Spectrometry ("IMS") mode of operation.

BRIEF DESCRIPTION OF THE DRAWINGS

Various embodiments will now be described, by way of example only, and with reference to the accompanying drawings in which.

DETAILED DESCRIPTION

Figure 1:
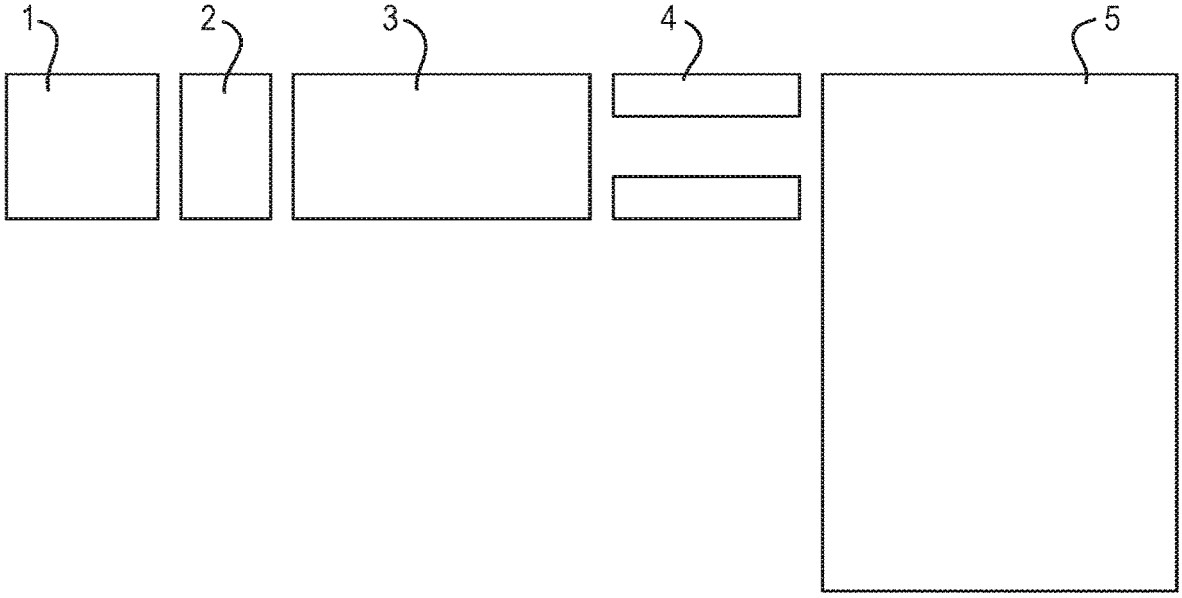
FIG. 1 shows a schematic representation of a mass and/or ion mobility spectrometer that may be operated in accordance with various embodiments.

According to various embodiments a substantially continuous beam of ions is generated. The beam of ions may be generated, for example, by ionising a sample (e.g. using an ion source) and/or by ionising a sample to generate parent or precursor ions and then fragmenting or reacting the parent or precursor ions (e.g. using a fragmentation, collision or reaction device) to generate the ions, etc.

A first group of ions is effectively formed by accumulating ions from the ion beam for a first continuous period of time T1. A second group of ions may then be effectively formed by accumulating ions from the ion beam for a second continuous period of time T2. The ions may be accumulated in an ion trap or in an ion accumulation region, such as a mass selective ion trap or a non-mass selective ion trap, or an accumulation region of an ion mobility separation device.

The second continuous period of time T2 may be substantially less that the first continuous period of time T1 (i.e. the first time T1 is substantially longer than the second time T2) such that the second group of ions comprises fewer ions than the first group of ions.

According to various embodiments, a plurality of first groups of ions is effectively formed in this way, by repeatedly accumulating ions for the first period of time T1, and a plurality of second groups of ions is effectively formed in this way by repeatedly accumulating ions for the second period of time T2. The method may alternate between forming a single first group of ions and a single second group of ions, etc. Additionally or alternatively, one or more first groups of ions may be formed, followed by one or more second groups of ions, followed by one or more first groups of ions, and so on.

According to various embodiments, each of the one or more first groups of ions is analysed so as to generate one or more "high intensity" (first) data sets, and each of the one or more second groups of ions is analysed so as to generate one or more "low intensity" (second) data sets. This may involve determining the mass to charge ratio of the ions (e.g. using a Time of Flight mass analyser), and/or determining the ion mobility, collision cross section and/or interaction cross section of the ions (e.g. using an ion mobility separator).

According to various embodiments, the rate at which alternate high and low intensity spectra are recorded is such that the composition of the sampled ion beam will be substantially the same for consecutive high and low intensity spectra. This ensures that the data sets are comparable. For example, in various embodiments, the ions are generated by ionising analyte from a chromatography system (e.g. ionising eluent from a liquid chromatography device), and the rate at which alternate high and low intensity spectra are recorded is set such that individual chromatography peaks will typically be sampled one or more times in each of the high and low intensity modes of operation.

According to various embodiments, it is then determined whether or not the one or more high intensity data sets comprise saturated and/or distorted data. Saturated data may arise where, for example, a data set comprises data having a value greater than or equal to the saturation level of the detector. Distorted data may arise, for example, due to space charge effects, e.g. when a large number of ions are trapped together in a small region (e.g. in the ion trap or accumulation region, or another, e.g. downstream, device), or otherwise.

In various embodiments, if it is determined that the one or more high intensity data sets comprise saturated and/or distorted data, then the saturated and/or distorted data from the one or more high intensity data sets is replaced with corresponding data from the one or more low intensity data sets. One or more individual data values may be replaced (for example, where a limited number of ion peak(s) in the data set meet or exceed the saturation level or are affected by space charge effects), or one or more entire data sets may be replaced (e.g. where space charge effects cause the entire data set(s) to be distorted), as appropriate. In various embodiments, the corresponding data from the low intensity data set is appropriately scaled before it is added to the high intensity data set.

As will be appreciated, the resulting composite spectrum will have an enhanced dynamic range.

In various embodiments, one or more or all of the groups of ions are separated according to one or more physicochemical properties such as ion mobility and/or mass to charge ratio before they are analysed. This may involve ejecting the accumulated ions from the ion trap or accumulation region (e.g. where the trap or accumulation region comprises a mass selective or analytical ion trap, wherein ions are ejected from the ion trap in order or reverse order of their mass to charge ratio) and/or passing the ions to a separation device, and then separating the ions in the separation device (e.g. where the separation device comprises an ion mobility separator). In various embodiments, this process is performed repeatedly for each group of ions as it is formed.

In various embodiments, the separation device is operated to separate ions in a cyclical manner. Each cycle of the separation device may involve the separation device receiving a group of ions (i.e. ions being injected into the separation device) over a certain (fourth) period of time $T_{inj}$, and then the separation device separating the received ions over a separation (third) time $T_{ims}$ that in various embodiments substantially immediately follows the fourth period of time. Once the separation device has separated a given group of ions (in the third period of time), the next cycle of separation may then begin. Thus, the separation device receives a further group of ions in a further fourth period of time $T_{inj}$ which may substantially immediately follow the separation (third) time $T_{ims}$, and so on. Accordingly, the separation device may be operable to perform multiple repeating cycles of separation, where each cycle of separation is performed during a fixed, repeating time period (cycle time) ($T_{inj}$+ $T_{ims}$).

The ions may also be filtered according to, e.g. mass to charge ratio or otherwise, before they are analysed. A quadrupole mass filter or other filtering device may be provided for this purpose.

In various embodiments, the processes of accumulating and analysing ions are performed repeatedly in synchronism with the cycle time of the separation device. In various embodiments, for each cycle of separation of the separation device, a first or second group of ions is accumulated during (at the same time as) the (third) period $T_{ims}$ and the group of ions may then be ejected from the ion trap or accumulation region into the separation device during the fourth period of time $T_{inj}$. Accumulating a set of ions at the same time as separating the previously accumulated set of ions has the effect of increasing duty cycle.

Thus, in various embodiments, the mass and/or ion mobility spectrometer is repeatedly switched between a first mode of operation in which the time in which a population of ions is allowed to enter an ion trapping region, optionally prior to a first ion mobility separation or set of ion mobility separations, is a first fixed time T1, and a second mode of operation in which the time in which ions are allowed to enter the trapping region, optionally prior to a second ion mobility separation or set of ion mobility separations, is a second (shorter) fixed time T2.

First ion mobility and/or mass spectral data may be obtained during the first mode of operation, and second ion mobility and/or mass spectral data may be obtained during the second mode of operation.

That is, ion mobility-mass to charge ratio ("IMS-m/z") data may be recorded for one or more populations of ions which have been accumulated in an upstream RF confined trapping region for a first accumulation time T1, and one or more subsequent ion mobility-mass to charge ratio ("IMS-m/z") data sets may be recorded for one or more populations of ions which have been accumulated for a second fixed time T2, where in various embodiments T1>T2. The trap accumulation time, optionally prior to ion mobility separation, may be alternated between two or more predetermined values to produce a high and low transmission or intensity, two dimensional, ion mobility-mass to charge ratio ("IMS-m/z") data set.

The accumulation time T1 may correspond to substantially the whole of the IMS separation time $T_{ims}$, i.e. in various embodiments T1=$T_{ims}$. This increases or maximises the number of ions that may be accumulated in the accumulation time T1. In the low transmission or intensity (second) mode of operation the accumulation time T2 may be set to be less than the time period during which the ions are traversing the ion mobility ("IMS") drift region $T_{ims}$, thereby reducing the intensity of ions delivered to the ion detector.

Accordingly, a pre-determined sequence of ion population control operations may be repeatedly performed so as to provide alternating high and low intensity data sets. Since each data set is collected over a deterministic time period, the data sets can then be "stitched together" or combined in post-processing in a relatively straightforward manner. This is particularly beneficial, e.g., where the ions are generated by ionising analyte from a chromatography device, e.g. such that each chromatography peak may be sampled one or more times in each of the high and low intensity data modes.

At least some of the second ion mobility and/or mass spectral data may be used instead of at least some of the first ion mobility and/or mass spectral data if it is determined that at least some of the first data has been affected by saturation or distortion. Portions of data which exceed the dynamic range of the detection system in the higher transmission data set may be replaced by corresponding data from the low transmission data set scaled by a suitable factor.

FIG. 1 shows schematically a mass and/or ion mobility spectrometer in accordance with various embodiments.

The mass and/or ion mobility spectrometer may comprise an ion source 1, an ion accumulation region or ion trap 2 arranged downstream of the ion source 1, an ion mobility separation device 3 arranged downstream of the ion accumulation region 2, an optional quadrupole mass filter 4 arranged downstream of the ion mobility separation device 3 and a mass analyser 5 (such as an orthogonal acceleration Time of Flight mass analyser) arranged downstream of the quadrupole mass filter 4.

According to various embodiments, in operation, ions may be produced in the ion source 1 and then accumulated in the accumulation region 2 before optionally being pulsed into the ion mobility separation device 3. As ions travel within the ion mobility separation device 3 a subsequent population of ions may be accumulated in the ion accumulation region 2.

Ions exiting the ion mobility separation device 3 may enter the quadrupole mass filter 4 which may be set to transmit substantially all the ions exiting ion mobility device 3 (i.e. in a so-called "RF only" mode). Alternatively, the mass filter 4 may be set to transmit ions over a narrow mass to charge ratio range (e.g. on application of an appropriate resolving DC voltage).

According to various embodiments, the mass to charge ratio ("m/z") range transmitted by the quadrupole mass filter 4 may be altered in synchronization with the elution of specific ions from the ion mobility separation device 3. Ions which exit the quadrupole mass filter 4 are mass analysed by the mass analyser 5.

FIGS. 2A-C and FIGS. 3A-3C show timing diagrams illustrating the operation of the mass and/or ion mobility spectrometer in accordance with various embodiments. FIGS. 2A-2C and FIGS. 3A-3C show the sequence of events within the mass and/or ion mobility spectrometer resulting in the alternating high and low transmission or intensity data sets according to various embodiments.

Figure 2A:
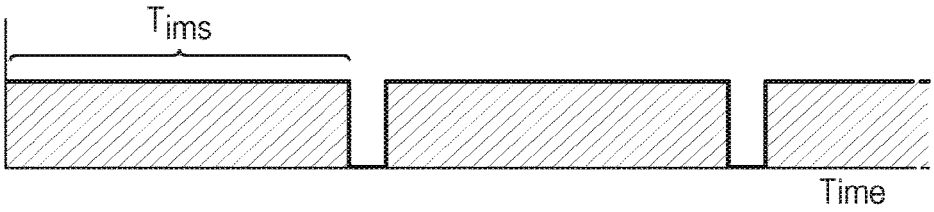
FIG. 2A illustrates the time allowed for a population of ions to be separated by an ion mobility separation device wherein each ion mobility separation cycle has a fixed duration of $T_{ims}$.
Figure 2B:
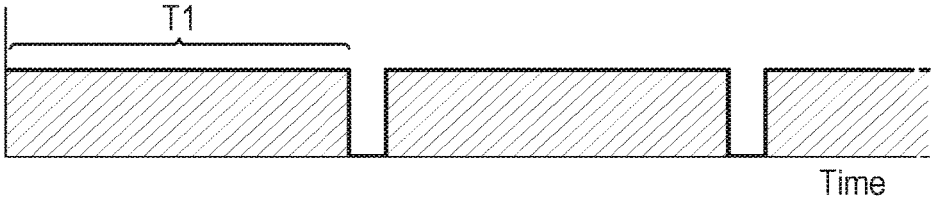
FIG. 2B illustrates the time T1 during which ions are accumulated in an accumulation region prior to ion mobility separation in a high transmission mode of operation according to various embodiments.
Figure 2C:
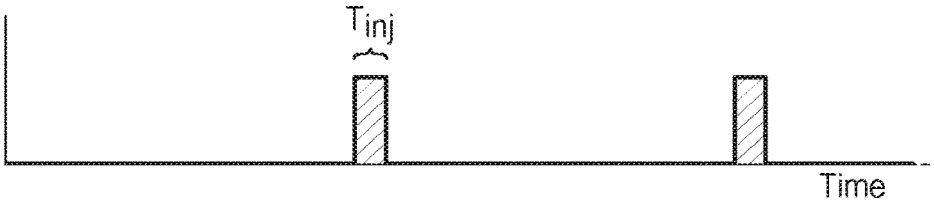
FIG. 2C illustrates the time $T_{inj}$ during which ions are ejected from the ion accumulation device and are injected into the ion mobility separation device in accordance with various embodiments.

FIGS. 2A-2C illustrate the high transmission or intensity cycle according to various embodiments.

FIG. 2A illustrates the time allowed for a population of ions to travel along (to be separated by) the ion mobility separation device 3. In the illustrated embodiment each ion mobility separation cycle has a fixed duration of $T_{ims}$. It should be noted, however, that this duration may be varied, e.g. depending on the application, in accordance with various other embodiments.

FIG. 2B illustrates the time T1 during which ions are accumulated in the accumulation region 2 prior to ion mobility separation. In the illustrated embodiment, the time T1 during which ions are accumulated within the ion accumulation region 2 is substantially the same as the time taken for a population of ions to travel through the ion mobility separation device 3. According to various embodiments, these times need not be the same (e.g. T1 could be less than $T_{ims}$) but setting these times to being substantially the same maximises the number of ions that are subsequently introduced into the ion mobility separation device 3 in each cycle.

FIG. 2C illustrates the time $T_{inj}$ during which ions are ejected from the ion accumulation device 2 and are injected into the ion mobility separation device 3. According to various embodiments $T_{inj} \ll T_{ims}$. In various embodiments, during the time $T_{inj}$ no ions enter the ion accumulation region 2.

The transmission or duty cycle (DC1) for this first, high intensity, mode of operation is given by:

$$DC1 = \frac{T1}{T_{ims} + T_{inj}} \tag{1}$$

Figure 3A:
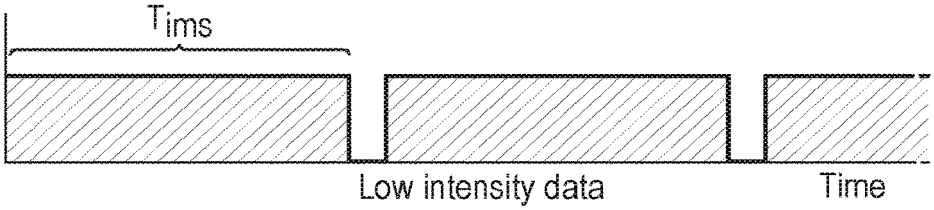
FIG. 3A illustrates the time $T_{ims}$ allowed for a population of ions to be separated by an ion mobility separation device.
Figure 3B:
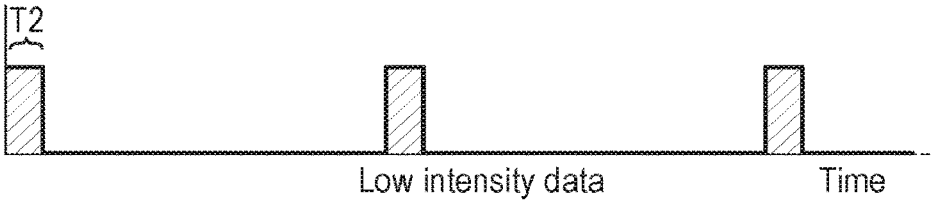
FIG. 3B illustrates the time T2 during which ions are accumulated in an accumulation region prior to ion mobility separation in a low transmission mode of operation according to various embodiments.
Figure 3C:
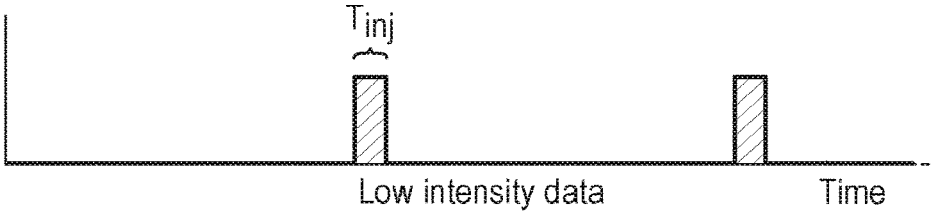
FIG. 3C illustrates the time $T_{inj}$ during which ions are ejected from the ion accumulation device and are injected into the ion mobility separation device according to various embodiments.

FIGS. 3A-3C illustrate the low transmission or intensity mode of operation in accordance with various embodiments.

FIG. 3A illustrates the time $T_{ims}$ allowed for a population of ions to travel along (to be separated by) the ion mobility separation device 3. In the illustrated embodiment, the time $T_{ims}$ for one ion mobility separation cycle is fixed.

FIG. 3B illustrates the time T2 during which ions are accumulated in the accumulation region 2 prior to ion mobility separation. The time T2 during which ions are accumulated within the ion accumulation region 2 may be less than the time $T_{ims}$ taken for a population of ions to travel through the ion mobility separation device 3 i.e. in various embodiments $T2 < T_{ims}$. In this case, the accumulation time T2 is less than $T_{ims}$, but the ions are effectively trapped during the separation time $T_{ims}$, before they are released for separation. That is, the accumulation time T2 is different to the total trapping time for the ions.

FIG. 3C illustrates the time $T_{inj}$ during which ions are ejected from the ion accumulation device 2 and are injected into the ion mobility separation device 3. In various embodiments during this time $T_{inj}$ a further population of ions does not enter the ion accumulation region 2.

The transmission or duty cycle (DC2) for this second, low intensity, mode of operation is given by:

$$DC2 = \frac{T2}{T_{ims} + T_{inj}} \tag{2}$$

In various embodiments, the ratio of DC2 to DC1 may be set to between around 1% and 10%. This provides a particularly useful dynamic range enhancement. However, any other suitable ratio may be used as desired.

In the embodiments illustrated in FIGS. 2A-2C and FIGS. 3A-3C, a sequence of ion mobility accumulations and separations are shown for both modes.

In various embodiments, the accumulation time or mode of operation may be switched or altered between ion mobility separation cycles. Accordingly, the duty cycle of the system may be alternated between the above fixed and predetermined values between single ion mobility ("IMS") separations or between sets of multiple ion mobility separations.

In one embodiment, the mode of operation may be switched between every ion mobility separation cycle. This results in a data set where the system is operating in the high transmission mode for around 50% of the total experimental time.

In various other embodiments several ion mobility separations may be performed under the same transmission mode and the results may be averaged or summed into a single ion mobility-mass to charge ratio ("IMS-m/z") data set or spectrum. For example, for a 100 ms total spectral time and a $T_{ims}$=10 ms, ten ion mobility separations may be performed and summed under each of the transmission conditions to give two dimensional single ion mobility-mass to charge ratio ("IMS-m/z") spectra alternating between high and low transmission at a rate of 10 spectra per second.

In these embodiments, the time allocated to acquiring data in the high transmission mode of operation and the low transmission mode of operation may be altered to optimize the overall duty cycle of the system. For example, 15 ion mobility cycles in the high transmission mode of operation may be summed followed by 5 ion mobility cycles in the low transmission mode of operation. As the time during which the system acquires data in the high transmission mode of operation is greater than the time during which the system acquires data in the low transmission mode of operation, the overall duty cycle is increased e.g. from approximately 50% to approximately 75%. Any suitable number of high transmission and low transmission cycles may be performed as desired.

Thus, in various embodiments in a given time period, n first groups of ions are effectively formed, and m groups of second ions are effectively formed, where n is greater than m. In other words, on average relatively more of the high transmission (first) groups of ions may be formed than the low transmission (second) groups of ions. In other embodiments, n may be equal to or less than m.

Figure 4A:
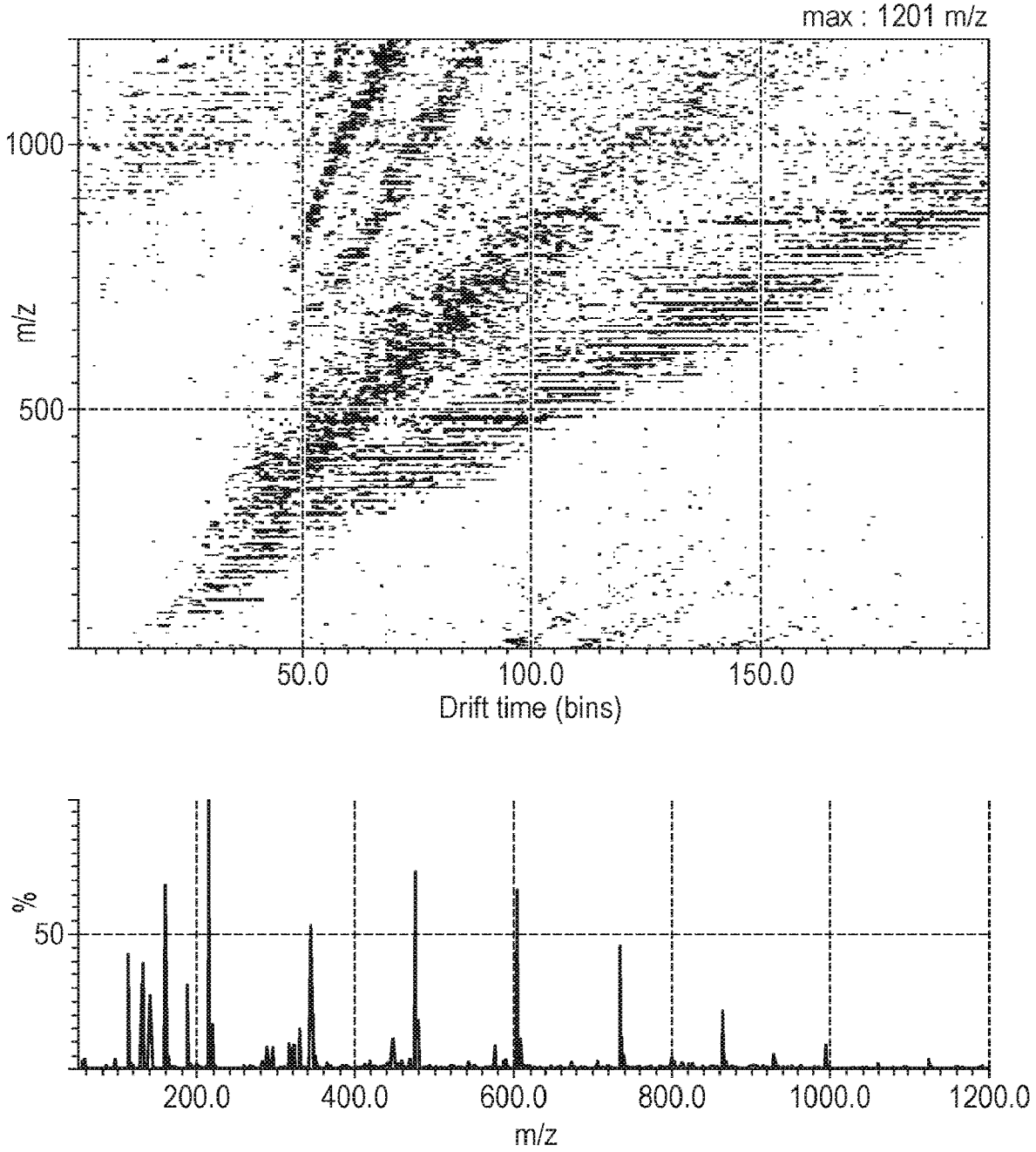
FIG. 4A shows a mass to charge ratio versus ion mobility drift time heat map and corresponding mass spectra from a high transmission mode of operation according to various embodiments.
Figure 4B:
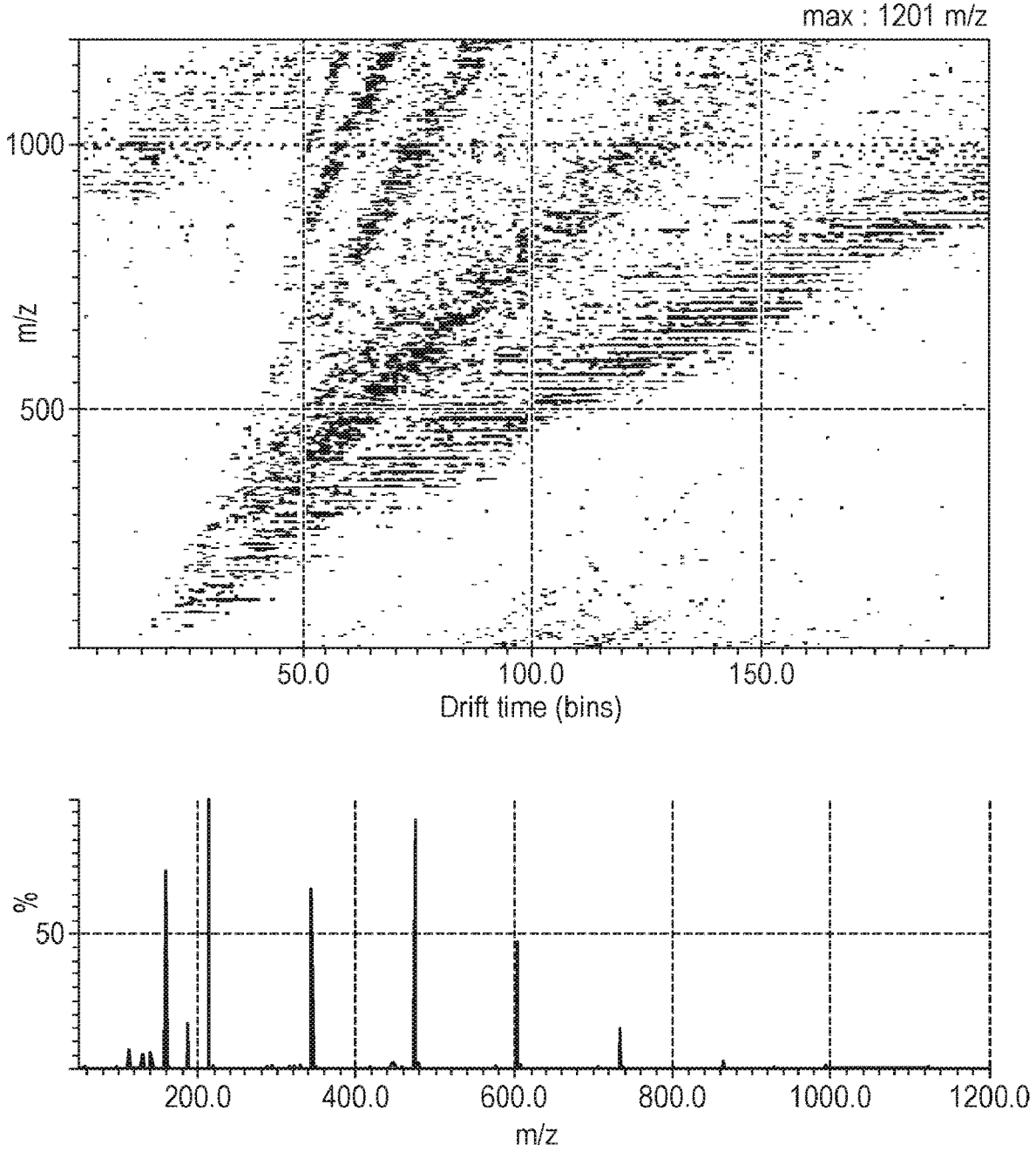
FIG. 4B shows a two dimensional mass to charge ratio versus ion mobility drift time heat map and corresponding mass spectrum from a low transmission mode of operation according to various embodiments.
Figure 4C:
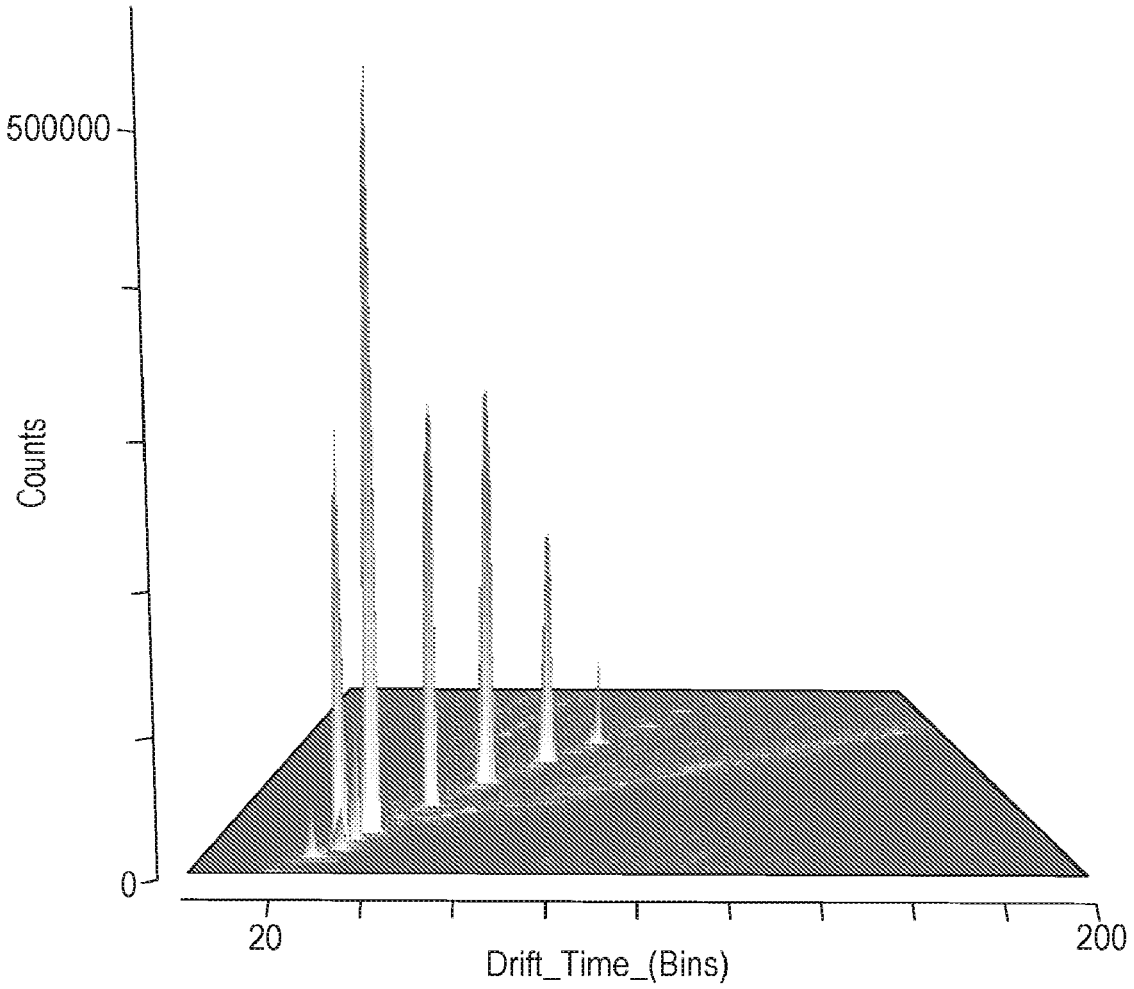
FIG. 4C shows a three dimensional plot of ion mobility drift time versus mass to charge ratio for a combined data set made by replacing data which exceeded the dynamic range of the detection system in the data shown in FIG. 4A with corresponding ion mobility-drift time points from the data shown in FIG. 4B with its intensity multiplied by 20 times.

FIGS. 4A-4C illustrate the process of combining the high and low transmission data to produce a high dynamic range spectrum according to various embodiments. FIG. 4A shows a mass to charge ratio ("m/z") versus ion mobility ("IMS") drift time heat map plot from a high transmission mode of operation and a corresponding mass spectrum. The mass spectrum below the heat map plot shows the same data as in the plot above but collapsed or summed in the mobility dimension. Significant distortion of the larger peaks in the spectrum has occurred due to detection system saturation.

FIG. 4B shows a two dimensional mass to charge ratio ("m/z") versus ion mobility ("IMS") drift time heat map and corresponding mass spectrum taken immediately after the spectra shown in FIG. 4A at a duty cycle of approximately 5% of the duty cycle utilised to obtain the data shown in FIG. 4A. Each spectrum was acquired over 100 ms from the summation of ten ion mobility separations of 10 ms duration. Lower detection system saturation is observed in this data as indicated by the markedly different relative ratios of the larger peaks in the mass spectrum.

FIG. 4C shows a three dimensional plot of ion mobility drift time ("DT") versus mass to charge ratio ("m/z") for a combined data set which was generated by replacing data which exceeded the dynamic range of the detection system in the data shown in FIG. 4A with corresponding ion mobility-drift time ("IMS-DT") points from the data shown in FIG. 4B, with its intensity multiplied by 20 times.

The resultant combined spectrum has a dynamic range of approximately ten times that of the spectra shown in FIGS. 4A and 4B.

Figure 5B:
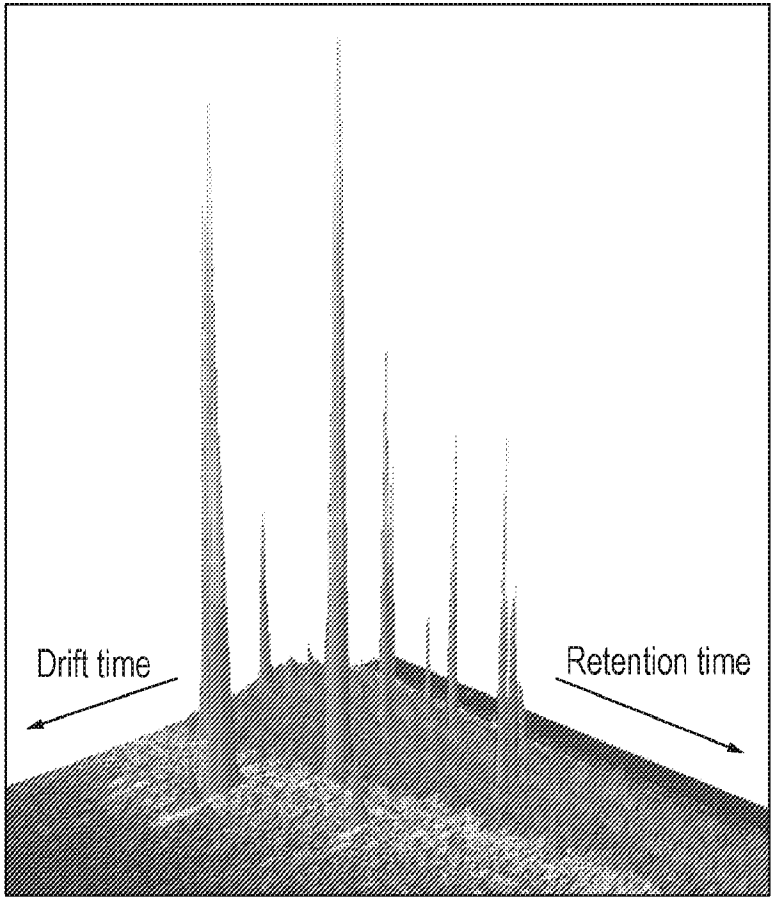
FIG. 5B shows an enhanced dynamic range spectra formed by combining 100% transmission and 5% transmission data in accordance with various embodiments.
Figure 5A:
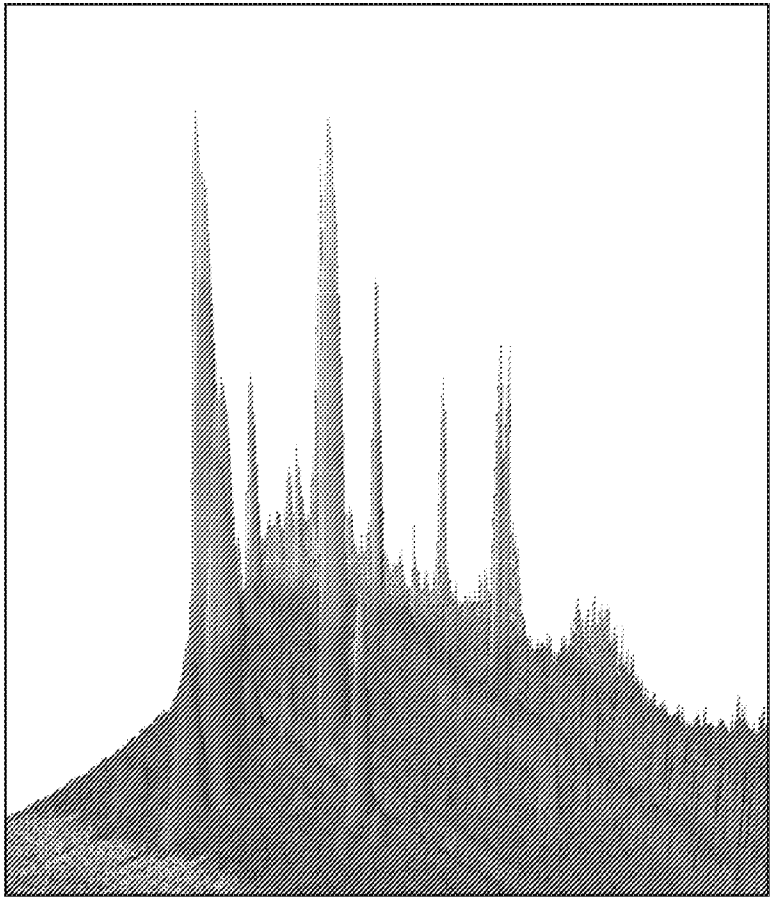
FIG. 5A shows a drift time versus liquid chromatography retention time plot for a liquid chromatography ion mobility mass spectrometry separation of small molecules at an acquisition rate of 10 spectra per second according to various embodiments.

FIG. 5A shows a drift time versus liquid chromatography ("LC") retention time plot for a liquid chromatography ion mobility mass spectrometry ("LC-IMS-MS") separation of small molecules at an acquisition rate of 10 spectra per second.

FIG. 5B shows the enhanced dynamic range spectra formed by combining 100% transmission and 5% transmission data in accordance with various embodiments. As the combined data is from two consecutive 100 ms acquisitions, the final spectral rate of the stitched high dynamic range data is 5 spectra per second, with an increase in dynamic range of 10×.

According to various other embodiments, the approach of the embodiments described above may be used to improve the dynamic range when coupling a mass selective ion trap to an orthogonal acceleration Time of Flight system e.g. to facilitate high duty cycle comprehensive MS-MS operation.

In these embodiments, a separate upstream accumulation region may be provided prior to the mass selective trap, with the ion accumulation time optionally alternating between two or more values, e.g. as described above. Alternatively, if no upstream accumulation region is provided, the time over which ions are accumulated directly into the analytical ion trap may be alternated between one or more different times, e.g. as described above. Again, the fill times may be predetermined prior to the start of the acquisition.

In these embodiments, low intensity and high intensity two dimensional mass to charge ratio versus mass to charge ratio data sets may be produced. A composite data set may be produced with higher dynamic range using the methods of the embodiments described herein.

According to various other embodiments, the same approach may be taken for arrangements wherein ions are trapped and then released to a mass analyser (e.g. to an orthogonal acceleration Time of Flight ("ToF") mass spectrometer, optionally without passing through a separation device). For example, in enhanced duty cycle mode ("EDC") or target enhancement mode ions may be firstly trapped, and the release of the ions may be synchronized with the orthogonal sampling pulse of the mass analyser to give high duty cycle over a limited mass to chare ratio ("m/z") range.

Alternating the trap fill time on a push to push or spectrum to spectrum basis and combining the two sets of data in accordance with various embodiments allows higher dynamic range to be realized.

Thus, according to various embodiments, a mass selective ion trap may be provided upstream of a time of flight mass analyser. According to various embodiments, a non-mass selective ion trap may be provided upstream of a mass selective ion trap which may be provided upstream of a time of flight mass analyser.

According to various embodiments, a non-mass selective ion trap may be provided upstream of a mass selective ion trap which may be provided upstream of a scanning quadrupole which may be provided upstream of a time of flight mass analyser. The scanning quadrupole may be operated in synchronism with the time of flight mass analyser for high sensitivity and high duty-cycle comprehensive MS-MS.

In various other embodiments, the techniques described herein may be applied to apparatus in which ions are trapped and released in reverse mass to charge ratio ("m/z") order and converge simultaneously at an orthogonal acceleration sampling electrode, thereby resulting in high duty cycle for the entire mass to charge ratio range (e.g. as described in U.S. Pat. No. 6,794,640 (Micromass)). Alternating the trap fill time and subsequently combining the time of flight data can improve the overall dynamic range of the data produced.

According to various embodiments, ions may be accumulated in an accumulation region or ion trap, and then may be mass selectively ejected from the accumulation region or ion trap, and then filtered by a quadrupole mass filter. Alternatively, ions may be accumulated in an accumulation region or ion trap, and then may be mass selectively ejected from another downstream analytical ion trap, and then filtered by a quadrupole mass filter. In these embodiments, the mass to charge ratio transmission window of the quadrupole mass filter may be altered (scanned) substantially in synchronism with the mass to charge ratio of the ions as they are mass selectively ejected from the ion trap.

According to various embodiments where the high intensity data set is not determined to be distorted or saturated, the high intensity data set may be used or retained, or alternatively the low intensity data set may be combined with the high intensity data set, and the combined data set may be used.

According to various further embodiments more than two different fill times may be used in a corresponding manner to that described above. Thus, in various embodiments one or more third and/or further groups of ions may be formed by, for each of the one or more third and/or further groups of ions, accumulating ions for a third and/or further different period of time. The one or more third and/or further groups of ions may be analysed to generate one or more third and/or further data sets, which may be used in the manner of the embodiments described above. In these embodiments, the highest intensity or duty cycle data set that is not determined to be distorted or saturated may be retained or used.

According to various embodiments, it may be determined whether or not a or the (e.g. first) data set comprises distorted data resulting from space charge effects. According to various embodiments this may be done based on the total ion current ("TIC"). In various embodiments, if the total ion current ("TIC") recorded in the high intensity data set is such that it is at a level at which it is known that the mass and/or ion mobility spectrometer (e.g. ion mobility ("IMS")) performance may be distorted due e.g. to space charge effects (e.g. such that it is above a threshold value), then it may be determined that the data set comprises distorted data, and the entire high intensity data set (e.g. ion mobility-mass to charge ratio ("IMS-m/z") data set) may then be replaced by data from the corresponding low intensity data set.

In these embodiments the accumulation time switching method is effectively used to produce a data set which is less distorted due to space charge effects, e.g. in the ion mobility separation device 3 and/or accumulation region 2, rather than less distorted due to detection system saturation effects.

The Applicants have furthermore recognised that other techniques for determining when space charge effects have occurred may be useful and desirable.

In some instrument geometries, the recorded signals or spectra (e.g. the TIC) may not give a suitable indication of the amount of charge accumulated e.g. in the ion trap or accumulation region. This may be primarily due to the imperfect transmission of a particular device or combination of devices between the ion trap or accumulation region and the acquisition (detector) system. In many cases, this transmission factor may be unknown or known only to a limited precision. This can lead to miscalculations of the accumulated charge in the ion trap or accumulation region where the calculation is based on the measured signal or spectra (e.g. TIC).

The transmission may also vary as a function of mass, mass to charge ratio, ion mobility or charge state, etc. For example, the transmission may vary as a result of the mass to charge ratio ("m/z") transmission profile of a Time of Flight ("ToF") mass spectrometer such as an orthogonal acceleration Time of Flight ("OA-ToF) mass analyser, as a result of one or more RF devices and/or as a result of the mass to charge ratio ("m/z") and/or charge transmission profiles of one or more electrostatic lenses. Furthermore, in addition to these transmission effects, the detection efficiency can also be mass, mass to charge ratio ("m/z") and/or charge state dependent, leading to similar effects.

These effects can make accurate calculation of the charge accumulated in the ion trap or accumulation region complicated, inaccurate or imprecise. This could then result in data being used that is distorted due to space charge effects.

Furthermore, in contrast with the above described embodiments in which it is determined whether detector saturation is present, it may not be possible to directly determine from an individual (e.g. high intensity) data set whether space charge effects are present. This is because space charge effects can change different mass spectral peaks in different ways (e.g. all the singly charged ions might be suppressed, but not the doubly charged ions, etc.) and can be relatively subtle.

Furthermore, according to various embodiments using the geometry shown in FIG. 1, the mass filter 4 may be set to resolve a particular parent or precursor ion after ion mobility separation in the ion mobility separation device 3. The parent or precursor ion may then be dissociated to form product ions which may then be mass analysed using the mass analyser 5. In these embodiments, the composition of the recorded mass spectrum will not represent the population of ions in the pre-ion mobility separation accumulation region 2, and therefore cannot directly be used to adjust the fill time of the accumulation device to avoid spectral distortion due to space charge effects in the accumulation region or IMS device.

Thus, according to various embodiments, it may be determined whether or not a high intensity (first) data set comprises distorted data resulting from space charge effects based on a comparison of the high intensity (first) data set and the corresponding low intensity (second) data set. Qualitative and/or quantitative differences between the high intensity data set and the low intensity data set may be determined and used to do this.

The Applicants have recognised that, absent space charge effects, the high intensity data set and the corresponding low intensity data set should be relatively similar where the only difference is a scaling factor that relates to e.g. the difference in the fill time between the two data sets (or more generally to the difference between the number of ions acquired for each data set).

Thus, if the high intensity data set and the corresponding low intensity data set are significantly different in some other way, then it may be determined that space charge effects are present. In particular, differences in the data sets in terms of some peaks being suppressed relative to others, mass to charge ratio ("m/z") changes, etc. may be indicative of the presence of space charge effects.

Additionally or alternatively, in various embodiments the expected scaling factor between the data sets and the corresponding experimentally determined scaling factor may be compared to determine the presence of space charge effects. If, for example, a 10× scaling factor is expected based on the fill time or otherwise, but a factor of more or less than this is measured, this may indicate the presence of space charge effects.

According to various embodiments, individual distorted peaks and/or the entire distorted spectra may be replaced when space charge effects are determined to be present.

Thus, according to various embodiments, the above described transmission effects may effectively be cancelled out by switching the fill time or duty cycle of ions entering an ion trap or accumulation region between two or more known values, e.g. as described above. As the duty cycle values are known, the effect on the final data set is predictable in the absence of space charge effects e.g. each component in the spectra should be simply scaled by the relative transmission factors.

On the other hand, in situations where space charge effects are present, the two or more spectra will exhibit differences. This is illustrated by FIG. 6.

Figure 6A:
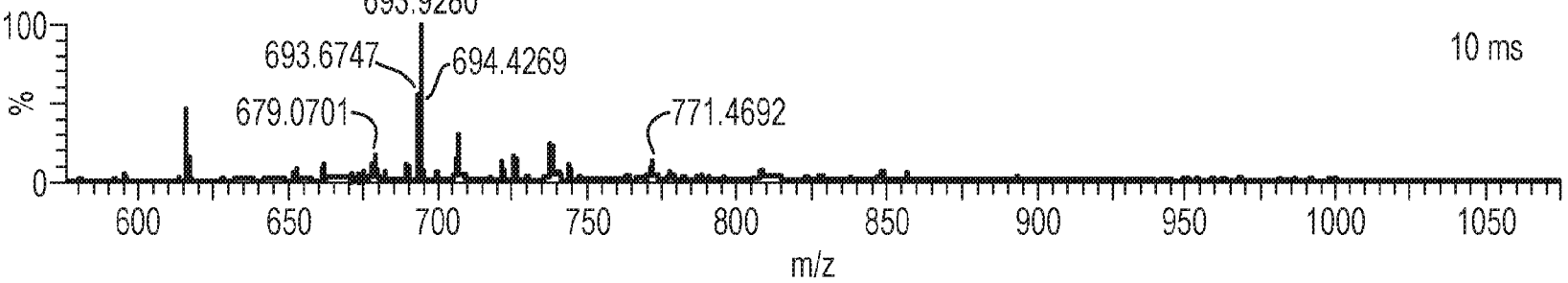
FIG. 6A shows data resulting from an infusion of a horse heart myoglobin sample which was ionised by an Electrospray ion source and wherein the resulting ions were analysed with an ion mobility spectrometry Time of Flight ("IMS-ToF") instrument with pre-ion mobility separation trapping for 10 ms to generate a high intensity data set in accordance with various embodiments.
Figure 6B:
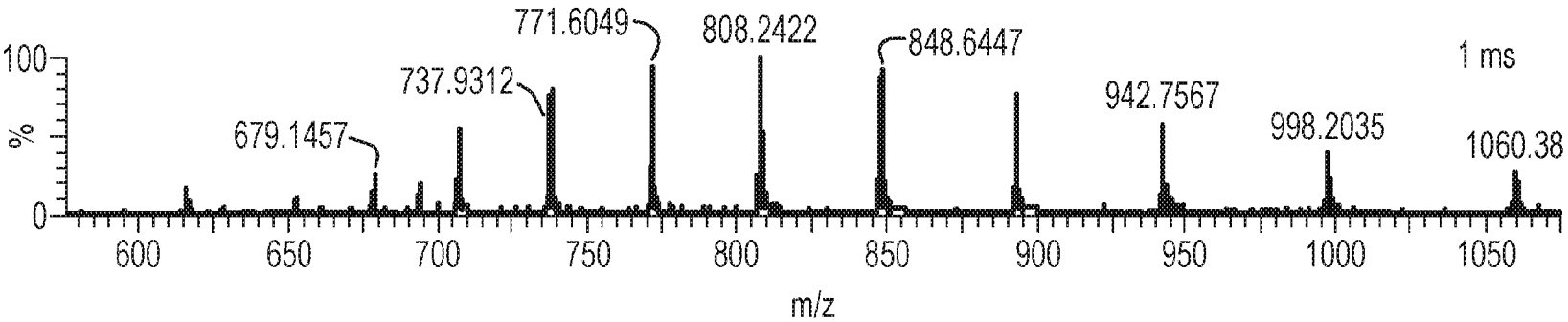
FIG. 6B shows data resulting from an infusion of a horse heart myoglobin sample which was ionised by an Electrospray ion source and wherein the resulting ions were analysed with an ion mobility spectrometry Time of Flight ("IMS-ToF") instrument with pre-ion mobility separation trapping for 1 ms to generate a low intensity data set in accordance with various embodiments.

FIGS. 6A and 6B shows the results of an infusion of a horse heart myoglobin sample which was ionised by an Electrospray ion source and wherein the subsequently generated ions were then analysed using an ion mobility separation Time of Flight ("IMS-ToF") instrument with pre-ion mobility separation trapping in accordance with various embodiments. The trap fill time was switched between two values, 10 ms and 1 ms, to generate a high intensity data set (as shown in FIG. 6A) and a low intensity data set (as shown in FIG. 6B). The two data sets are clearly qualitatively different.

Thus, in an approach according to various embodiments, the two spectra or data sets (i.e. the high intensity data set and the low intensity data set) may be compared taking in to account the known duty cycle factor (e.g. as described above). If the data sets are determined to differ significantly (i.e. in a way which does not simply relate to the differences in intensities), then data associated with the lower duty cycle (the low intensity data set) may be retained (i.e. in place of the distorted high intensity data set) in the manner as described above.

According to various embodiments, the comparison step may be achieved by simply comparing the total ion current ("TIC") values or by comparing TIC values in one or more regions of the mass to charge ratio ("m/z") range, or by more computationally intensive point to point comparisons. The comparison may also take place after mass spectral and/or ion mobility spectral peak detection, where detected peaks may be compared individually or in bulk.

In embodiments that use the geometry shown in FIG. 1 and as described above, where the composition of the recorded mass spectrum does not represent the population of ions in the pre-ion mobility separation accumulation region 2, the intensity difference between the data sets produced using the different accumulation times may be compared to the known difference in accumulation time (or otherwise) between the two data sets, which in various embodiments enables distortions due to space charge effects, prior to the mass filter 4, to be recognised. If the spectra are deemed to differ significantly the data set associated with the lower duty cycle or lower accumulation time may be retained (i.e. in place of the high intensity data set).

According to various embodiments, the comparison may involve determining the presence of local or bulk drift time shifts for the same species between the high and low intensity or transmission data sets. Space charge effects in the ion mobility separation device may cause such local or bulk drift time shifts for the same species between the high and low transmission data sets. This distortion may be used to recognise corruption of a (e.g. IMS-MS) data set or spectrum and may be used to determine that data from the corresponding low transmission cycle should be utilised in its place, e.g. as described above.

The approach of these embodiments may also be used to control and account for other effects related to total charge in a or the ion trap or accumulation region such as ion-ion or ion-neutral reactions.

In embodiments where the fill time is switched between more than two values, the retained data may be taken from the highest duty cycle data set that is determined not to differ from the next lowest duty cycle data set.

In embodiments where the data sets associated with two or more duty cycle values are deemed to be the same, the data sets may be combined.

The Applicants have furthermore recognised that these embodiments for determining the presence of space charge effects by comparing corresponding high and low intensity data sets may be applied to other dynamic range enhancement ("DRE") techniques where high and low intensity data sets are produced, i.e. not necessarily using differing trap fill times.

For example, according to various embodiments, the transmission of a device may be switched between high transmission and low transmission modes of operation to produce corresponding high intensity and low intensity data sets.

According to various embodiments the transmission of a device upstream of the ion trap or ion accumulation region may be switched between two or more known values, to thereby achieve similar effects to those described above.

In this case, a transmission altering device may be provided upstream of an ion trap, e.g. such that instead of altering the accumulation time (as discussed above), the transmission is altered, e.g. with a constant trapping time. That is, an ion trap may be configured to accept ions at all times, but the ion beam upstream of the ion trap may be thinned out or chopped, e.g. with a known duty cycle. In these embodiments, any chopping of the ion beam should be synchronised to the start and end times of the ion accumulation in the ion trap.

According to various embodiments, the approach according to various embodiments can be applied to feedback modes of operation.

According to various embodiments, the approach of comparing two data sets to decide which to utilise can also be applied to "ToF only" DRE experiments that do not necessarily involve ion traps.

According to various embodiments, the mass to charge ratio ("m/z") values measured for individual peaks may be compared between the high and low transmission data sets. If the mass to charge ratio ("m/z") differs significantly for individual peaks (i.e. within statistical tolerances), it can in various embodiments be inferred that the data associated with this mass to charge ratio ("m/z") in the high transmission spectra has exceeded the dynamic range of the system e.g. due to space charge effects. Data for this mass to charge ratio ("m/z") value may then be taken from the low transmission data set scaled by the appropriate factor.

Similarly, according to various embodiments, the ratio of intensities in the high and low transmission spectra for individual peaks may be calculated and compared to the known attenuation ratio. This information may then be used to select data from the high and low transmission data sets or spectra to combine into a composite high dynamic range data set or spectrum.

According to various embodiments, for targeted experiments the ratio of the isotope peaks in each data set or spectrum may be compared between the high and low transmission data sets, and may be used in the manner of the embodiments described above, i.e. to determine whether saturated and/or distorted data is present.

According to various further embodiments, rather than forming first and second groups of ions by varying the accumulation time in respect of the first and second groups of ions, plural initial groups of ions comprising substantially equal or similar numbers of ions may be formed, e.g. by accumulating or trapping groups of ions for substantially equal times (or otherwise), and then first and second groups of ions comprising differing numbers of ions may be formed from the initial groups of ions, e.g. by extracting or otherwise separating different portions (e.g. different percentages) of ions from different ones of the initial groups of ions.

By extracting or separating different amounts of ions from each of plural different initial groups of ions, a dynamic range enhancement (DRE) can be effected in a corresponding manner to that described above.

Furthermore, in these embodiments, filling the ion trap 2 for the same time for each accumulation cycle, and ensuring that the composition of the initial ion population is uniform over the trapping (spatial) dimension (prior to the extraction or separation), ensures that the portion (percentage) of the ion population (the first or second group of ions) extracted from the trap 2 and subsequently separated is representative of the composition of the entire population of ions, even when a very low proportion of ions is extracted from the trap 2.

This can avoid problems associated with ions of different mobilities taking different times to traverse the gate region at the entrance of the trap 2, e.g. because as the accumulation time becomes shorter, ions of lower mobility may not traverse the gate or trap entrance region and may be subsequently lost when the gate is closed to terminate the ion accumulation time. This means that, in these embodiments, the first and the second groups of ions may be more representative, thereby reducing spectral distortion and quantitative errors in the data.

The initial groups of ions may be extracted or otherwise separated from the ion trap, trapping or accumulation region in any suitable and desired manner.

In various embodiments, an initial group of ions may be spatially separated or segmented within an ion trap, trapping or accumulation region. This may be achieved, for example, by raising a DC barrier inside the ion trap, trapping or accumulation region so as to segment the initial group of ions into two (or more) differently sized portions. The appropriate portion of ions may then be accelerated into a downstream device (e.g. separation (IMS) device), for analysis, etc., e.g. as described above.

In various other embodiments, only a portion of an initial group of ions may be ejected from an ion trap, trapping or accumulation region.

This may be achieved, for example, by trapping ions within an ion trap, trapping or accumulation region that has at least one relatively extended dimension (e.g. length, width or height), and by allowing ions to exit the ion trap, trapping or accumulation region only through a relatively compact (in the at least one dimension) exit aperture or region. Alternatively, ions may be ejected from the ion trap, trapping or accumulation region using a pusher electrode that is relatively compact (in the at least one dimension). For example, an initial group of ions may be trapped within a linear or planar ion trap, trapping or accumulation region, wherein the line (linear trapping region) or plane (planar trapping region) in which ions are trapped is relatively extended in comparison to an exit aperture or region of the trap and/or in comparison to a pusher electrode.

Alternatively, an initial group of ions may be trapped within an ion trap, trapping or accumulation region that has at least one relatively extended dimension (e.g. length, width or height) relative to an entrance aperture or acceptance area of a downstream device (e.g. IMS device). For example, an initial group of ions may be trapped within a linear or planar ion trap, trapping or accumulation region, wherein the line (linear trapping region) or plane (planar trapping region) in which ions are trapped is relatively extended in comparison to an entrance aperture or acceptance area of a downstream device. A central axis of the line (linear trapping region) or plane (planar trapping region) may be orthogonal to a central axis of the downstream device (e.g. IMS device). Some or all of the ions in the ion trap, trapping or accumulation region may be accelerated or otherwise ejected from the ion trap, trapping or accumulation region into the downstream device, e.g. such that only a portion of the ions are received or onwardly transmitted by the downstream device (e.g. IMS device).

In these embodiments, the ejected portion of ions may then be analysed (separated, etc.), e.g. as described above.

In these embodiments, the unused portion(s) of the initial groups of ions may be discarded or otherwise.

In these embodiments, it may be beneficial to wait for each of the initial groups of ions to become fully distributed throughout the ion trap, trapping or accumulation region in which the initial groups of ions are formed before extracting or otherwise separating the ions, e.g. to avoid any IMS-type separation effects, i.e. so that each of the first and second groups of ions is representative of the initial group of ions.

Thus, according to various embodiments, a plurality of initial groups of ions are formed by, e.g., for each of the initial groups of ions, accumulating ions for a period of time in an ion trap or other accumulation region.

One or more first groups of ions may then be formed by, for each of the first groups of ions extracting or separating a first portion or all of the ions from an initial group of ions, and one or more second groups of ions may be formed by, for each of the second groups of ions extracting or separating a second different portion (i.e. less than all) of the ions from an initial group of ions.

The one or more first groups of ions may be analysed to generate one or more first data sets, and the one or more second groups of ions may be analysed to generate one or more second data sets, e.g. as described above. It may then be determined whether the one or more first data sets comprise saturated and/or distorted data, e.g. as described above. If (when) it is determined that the one or more first data sets comprise saturated and/or distorted data, then the saturated and/or distorted data from the one or more first data sets may be replaced with corresponding data from the one or more second data sets, e.g. as described above.

Each of the initial groups of ions may comprise a substantially equal quantity of ions, and the second portion may be less than the first portion, i.e. such that each of the one or more second groups of ions may comprise fewer ions than each of the one or more first groups of ions.

Ion may be allowed to disperse equally throughout the ion trap, trapping or accumulation region in which the initial groups of ions are formed before they are extracted or separated, e.g. such that the first and/or second groups of ions are representative of the initial group of ions.

These embodiments can (and in various embodiments do) include any one or more or all of the optional features described herein.

Thus, for example, on average relatively more of the high transmission (first) groups of ions may be formed than the low transmission (second) groups of ions.

The rate at which alternate first and second groups of ions are accumulated and analysed may be such that the composition of consecutive first and second groups of ions are substantially the same, e.g. as described above.

A group of ions may be separated according to one or more first physico-chemical properties before they are analysed, e.g. as described above.

A group of ions may be formed (e.g. accumulated and/or extracted or separated) at the same time as analysing one or more other groups of ions, e.g. as described above.

A group of ions may be formed (e.g. accumulated and/or extracted or separated) at the same time as separating according to one or more first physico-chemical properties one or more other groups of ions, e.g. as described above.

A separation device may be operated in a cyclical manner so as to repeatedly separate respective groups of ions according to the one or more first physico-chemical properties, and ions may be accumulated (and extracted or separated) and analysed repeatedly in synchronism with the cycle time of the separation device, e.g. as described above.

A group of ions may be filtered according to one or more second physico-chemical properties before being analysed, e.g. as described above.

A group of ions may be formed (e.g. accumulated and/or extracted or separated) at the same time as filtering according to one or more second physico-chemical properties another groups of ions, e.g. as described above.

Data from the one or more first data sets may be compared with data from the one or more second data sets in order to determine whether the one or more first data sets comprises saturated and/or distorted data, e.g. as described above.

Accordingly, in various embodiments, ions may be accumulated in an ion trap, e.g. for each of plural repeating fixed time periods, i.e. so as to form substantially corresponding populations of ions (e.g. having the same or similar quantities of ions). A different portion or percentage of each of the populations may then be released into a downstream device (e.g. separator) and the remaining ions within the ion trap may be discarded or directed elsewhere.

For example 100% of the ions of an initial group of ions may be released from the ion trap, e.g. into the downstream separator, so as to form a "first" group of ions.

As the first group of ions is separated by the separation device, another initial group of ions may be accumulated in the ion trap. At the end of this second accumulation, 10% of the group of ions may be released, e.g. into the downstream separator, so as to form a "second" group of ions.

This may be repeated multiple times, i.e. from initial group of ions to initial group of ions, or one or plural first groups of ions may be formed followed by one or plural second groups of ions, and so on, e.g. as described above.

The first and second groups of ions may be analysed, e.g. as described above.

Data recorded from analysis of the first group(s) of ions and data recorded from analysis of the second group(s) of ions may then be combined into a single high dynamic range data set, e.g. after appropriate scaling, e.g. as described above. For example, where the portions respectively comprise 100% and 10% of the ions, the data derived from the second group of ions may be scaled by a factor of 10 times.

FIG. 7 illustrates the operation of a mass and/or ion mobility spectrometer in accordance with various embodiments. In the embodiment illustrated by FIG. 7, an ion trap or trapping region 2 is operable to isolate a small percentage of the total ion population accumulated within the trapping region 2 (e.g. so as to form a "second" (low intensity) group of ions), and to subsequently deliver the isolated ions to a downstream separator 3.

As shown in FIG. 7, the mass and/or ion mobility spectrometer may comprise an ion guide or ion guide region 6, an ion trap or trapping region 2 downstream of the ion guide or ion guide region 6, and a separation device or separation region 3 downstream of the ion trap or trapping region 2. Each of these may comprise a separate, distinct device, or they may be formed as a single ion guide comprising multiple regions or stages. The ion guide or ion guide region 6, the ion trap or trapping region 2, and the separation device or separation region 3 may be in the form of one or more stacked ring ion guides, i.e. comprising plural electrodes each having an aperture or opening through which ions may travel in use. One or more RF voltages sources may be provided that may be configured to apply one or more RF voltages to the electrodes so as to confine ions radially within the ion guide(s). Opposite phases of the RF voltage may be applied to axially adjacent electrodes. Other arrangements would be possible.

FIG. 7 also illustrates various DC potentials which may be applied to the electrodes at different points in the operation of the mass and/or ion mobility spectrometer, e.g. during the trapping and release of ions, in accordance with various embodiments.

Figure 7A:
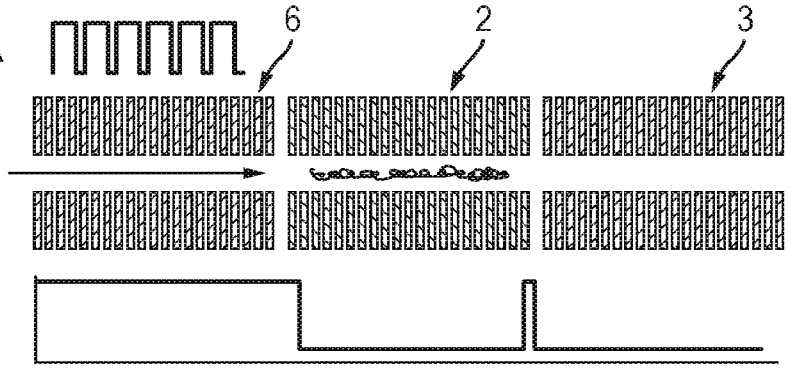
FIG. 7A illustrates the operation of a mass and/or ion mobility spectrometer in accordance with various embodiments.

As shown by FIG. 7A, an initial group of ions, e.g. from an upstream ion source 1, may be accumulated within the trapping region 2. This may be achieved by transporting (e.g. forcing) ions from the ion guide 6 into the trapping region 2, e.g. by using one or more travelling DC waves and/or one or more static DC fields applied to electrodes of the ion guide 6. A DC gate voltage may be applied to an electrode at the downstream end of the trapping region 2 so as to prevent ions leaving the trapping region 2.

Once ions have populated the entire ion trap 2, ions may be prevented from entering the trap 2, e.g. by applying a DC voltage to a gate electrode upstream of the trapping region 2. In various embodiments, the composition of the population of ions should be substantially constant throughout the length of the trap 2. This may be achieved (where necessary) by allowing the ions to remain in the ion trap 2 for a suitable period of time such that they become distributed throughout the ion trap 2.

Figure 7B:
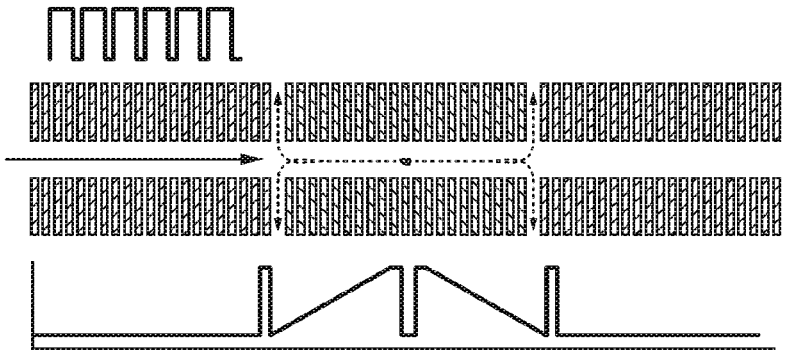
FIG. 7B illustrates the operation of a mass and/or ion mobility spectrometer in accordance with various embodiments.

As shown in FIG. 7B, the applied DC voltages may be adjusted to form a relatively small trapping region within the trap 2. That is, one or more DC voltages may be applied to the electrodes of the trapping region 2 such that an DC potential well is formed inside the ion trap 2, e.g. at or close to the centre of the trap.

Ions outside of the trapping region or well may be ejected from the ion trap 2. As shown in FIG. 7B, this may be achieved by applying DC voltages to the electrodes of the trap 2 such that the ions outside of the well experience a linear field that cause the ions to be expelled from the trap 2, and e.g. eventually outside the electrode structure. The dotted arrows in FIG. 7B show the path of the ions during this operation.

Many different schemes for flushing unwanted ions from outside the small trapping region or well are envisaged, including for example, (i) the use of one or more travelling DC waves; (ii) the use of one or more deflection voltages; (iii) selectively lowering one or more of the RF confining voltages; or (iv) combinations of any of the schemes.

Figure 7C:
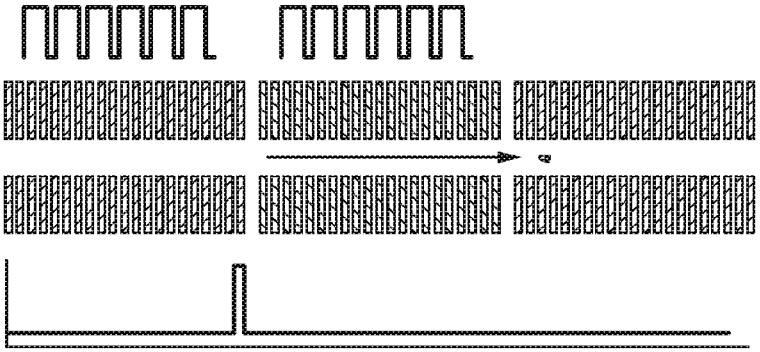
FIG. 7C illustrates the operation of a mass and/or ion mobility spectrometer in accordance with various embodiments.

After unwanted ions have left the trap region 2, the remaining ions may be released or transferred into the separator region 3. This is illustrated by FIG. 7C. This may be achieved, for example, using one or more travelling DC waves and/or one or more static DC fields, etc., e.g. so as to move ions from one region to another.

This ("second") group may then be separated in the separation region 3, e.g. by forcing the ions through the separation region 3 using one or more travelling DC waves and/or one or more static DC fields applied to the electrodes of the separation region 3.

Figure 7D:
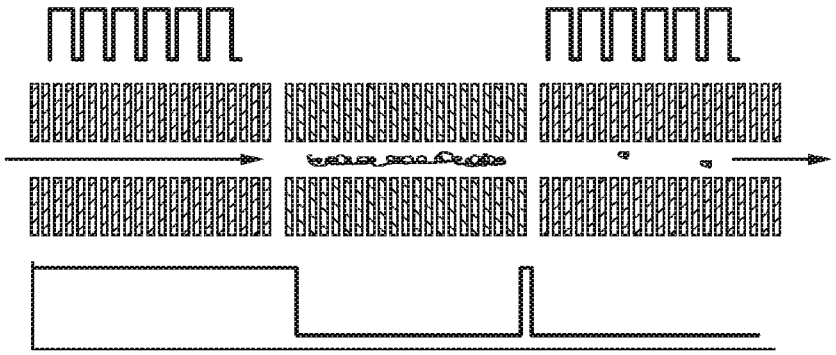
FIG. 7D illustrates the operation of a mass and/or ion mobility spectrometer in accordance with various embodiments.

As shown in FIG. 7D, as the ("second") group of ions is separated in the separation region 3, a further population of ions may be accumulated in the trapping region 2. A "first" or "second" group of ions may then be formed from this population of ions as desired. This has the effect of increasing the duty cycle.

In these embodiments, "first" (high intensity) groups of ions may be formed by omitting the step of forming a relatively small trapping region or well within the trap 2 or by forming a relatively large trapping region or well within the trap 2 (e.g. in a corresponding manner to that discussed above).

FIG. 8 illustrates the operation of a mass and/or ion mobility spectrometer in accordance with various other embodiments.

Figure 8A:
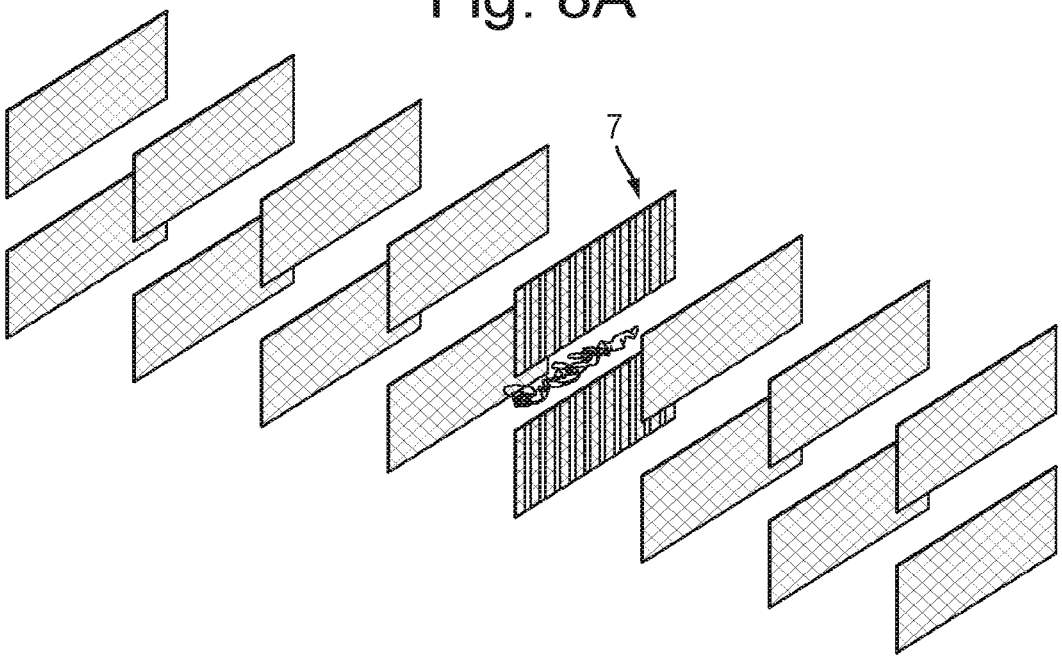
FIG. 8A illustrates the operation of a mass and/or ion mobility spectrometer in accordance with various embodiments.

As shown in FIG. 8A, an exit electrode 7 of a trapping region 2 may be segmented such that when ions are extracted from the trapping region 2, one or more potential barriers 8 may be formed so as to allow only a proportion of the ions to exit the trapping region 2 and to enter the downstream separation region 3, while preventing the remaining portion of the ions within the trapping region 2 exiting the trapping region 2 and entering the downstream separation region 3.

Figure 8B:
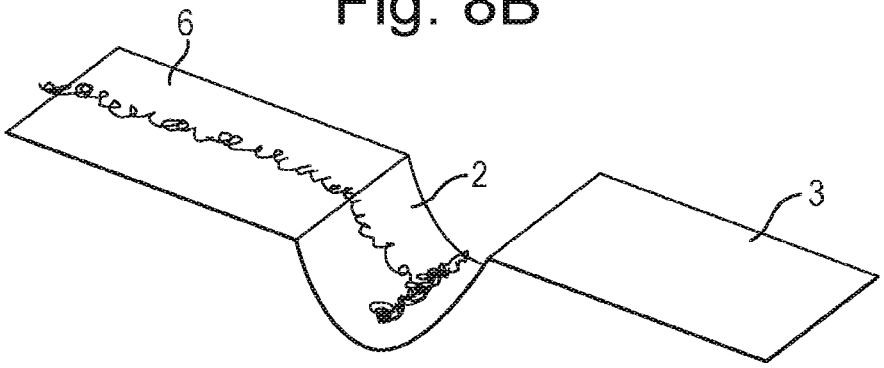
FIG. 8B illustrates the operation of a mass and/or ion mobility spectrometer in accordance with various embodiments.
Figure 8C:
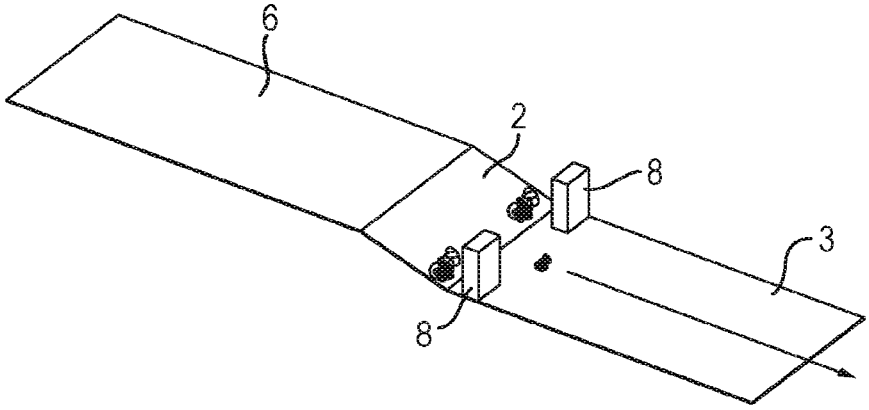
FIG. 8C illustrates the operation of a mass and/or ion mobility spectrometer in accordance with various embodiments.

As shown in FIG. 8B, ions may be accumulated into a trapping region 2, e.g. from an upstream ion guide or ion guiding region 2 or otherwise. Once the trapping region 2 is filled with ions, then, as shown in FIG. 8C, one or more DC potential barriers 8 may be formed on the segmented exit electrode 7 of the ion trapping region 2, and one or more voltages (e.g. one or more travelling DC waves and/or one or more static DC fields, etc.) may be applied to the ion trap region 2 so as to expel some of the ions from the ion trap 2, while some ions remain within the ion trap 2 due to the one or more DC potential barriers 8.

The ejected ("second") group of ions may then be separated in the separation region 3, e.g. as described above.

Once the desired ions have exited the trap 2, the remaining ions may be flushed out of the trapping region 2, e.g. by known methods.

In these embodiments, "first" (high intensity) groups of ions may be formed by omitting the DC potential barriers 8 or by forming relatively smaller or narrower DC potential barriers 8.

According to various embodiments, a combination of the variable accumulation time techniques and the variable ion population extraction techniques described herein may be used to produce the attenuated data. Combining these techniques can allow significantly more overall attenuation of the ion beam at the detector, e.g. compared to either technique alone. For example, a combination of a 1% accumulation time, and a 1% final extraction proportion will give a total attenuation of 0.01%.

In various embodiments, the attenuation factor for different trap exit conditions may be appropriately characterised and calibrated.

It will be appreciated from the above that various embodiments provide methods in which the dynamic range of mass spectral data and/or ion mobility-mass spectral ("IMS-MS") data is increased. This improves quantitative results, mass accuracy and collision cross section measurement accuracy by reducing detector system saturation effects.

Although the present invention has been described with reference to preferred embodiments, it will be understood by those skilled in the art that various changes in form and detail may be made without departing from the scope of the invention as set forth in the accompanying claims.

The invention claimed is:

1. A method of mass and/or ion mobility spectrometry comprising:

accumulating ions for a first period of time one or more times so as to form one or more first groups of ions;

accumulating ions for a second period of time one or more times so as to form one or more second groups of ions, wherein said second period of time is less that said first period of time;

analysing said one or more first groups of ions to generate one or more first data sets;

analysing said one or more second groups of ions to generate one or more second data sets; and determining whether said one or more first data sets comprise saturated and/or distorted data;

wherein when it is determined that said one or more first data sets comprise saturated and/or distorted data, then said method further comprises:

replacing said saturated and/or distorted data from said one or more first data sets with corresponding data from said one or more second data sets; and wherein:

said method comprises accumulating said ions so as to form one or more of said one or more first and/or second groups of ions and at the same time separating according to one or more first physico-chemical properties one or more of said one or more first and/or second groups of ions;

said step of separating ions according to said one or more first physico-chemical properties comprises operating a separation device in a cyclical manner so as to repeatedly separate respective groups of ions according to said one or more first physico-chemical properties during a third period of time;

said steps of accumulating and analysing said ions are performed repeatedly in synchronism with the cycle time of said separation device; and said third period of time is approximately equal to said first period of time and said second period of time is less than said third period of time.

2. A method as claimed in claim 1, wherein each of said one or more second groups of ions comprises fewer ions than each of said one or more first groups of ions.

3. A method as claimed in claim 1, wherein the rate at which alternate first and second groups of ions are accumulated and analysed is such that the composition of consecutive first and second groups of ions are substantially the same.

4. A method as claimed in claim 1, wherein said method comprises:

accumulating said ions so as to form one or more of said one or more first and/or second groups of ions and at the same time analysing one or more of said one or more first and/or second groups of ions.

5. A method as claimed in claim 1, further comprising separating said one or more first groups of ions and/or said one or more second groups of ions according to one or more first physico-chemical properties before said step of analysing said one or more first groups of ions and/or said one or more second groups of ions.

6. A method as claimed in claim 1, wherein said one or more first physico-chemical properties comprise mass to charge ratio, ion mobility, collision cross section and/or interaction cross section.

7. A method as claimed in claim 1, further comprising filtering said one or more first groups of ions and/or said one or more second groups of ions according to one or more second physico-chemical properties before said step of analysing said one or more first groups of ions and/or said one or more second groups of ions.

8. A method as claimed in claim 1, wherein said method comprises:

accumulating said ions so as to form one or more of said one or more first and/or second groups of ions and at the same time filtering according to one or more second physico-chemical properties one or more of said one or more first and/or second groups of ions.

9. A method as claimed in claim 8, wherein said one or more second physico-chemical properties comprises mass to charge ratio, ion mobility, collision cross section, and/or interaction cross section.

10. A method as claimed in claim 1, wherein said step of determining whether said one or more first data sets comprises saturated and/or distorted data comprises:

determining whether said one or more first data sets comprises data having a value greater than or equal to a detector saturation level; and/or determining whether said one or more first data sets comprises distorted data resulting from space charge effects; and/or comparing data from said one or more first data sets with data from said one or more second data sets.

11. A method as claimed in claim 1, wherein said step of replacing said saturated and/or distorted data from said one or more first data sets with said corresponding data from said one or more second data sets comprises:

replacing one or more saturated and/or distorted data values or peaks from said one or more first data sets with one or more corresponding data values or peaks from said one or more second data sets; and/or replacing one or more of said one or more first data sets with one or more of said one or more second data sets.

12. A mass and/or ion mobility spectrometer comprising:

a device configured to accumulate ions for a first period of time one or more times so as to form one or more first groups of ions;

a device configured to accumulate ions for a second period of time one or more times so as to form one or more second groups of ions, wherein said second period of time is less that said first period of time;

an analyser configured to analyse said one or more first groups of ions to generate one or more first data sets and to analyse said one or more second groups of ions to generate one or more second data sets; and a control system configured to determine whether said one or more first data sets comprise saturated and/or distorted data;

wherein said control system is further configured to, when it is determined that said one or more first data sets comprise saturated and/or distorted data:

replace said saturated and/or distorted data from said one or more first data sets with corresponding data from said one or more second data sets; and wherein:

the spectrometer further comprises a separation device;

the spectrometer is configured to accumulate the ions so as to form one or more of said one or more first and/or second groups of ions and at the same time to separate according to one or more first physico-chemical properties one or more of said one or more first and/or second groups of ions;

the spectrometer is configured to separate ions according to one or more first physico-chemical properties by operating the separation device in a cyclical manner so as to repeatedly separate groups of ions according to said one or more first physico-chemical properties during a third period of time;

the spectrometer is configured to accumulate and analyse ions repeatedly in synchronism with the cycle time of said separation device; and said third period of time is approximately equal to said first period of time, and said second period of time is less than said third period of time.

13. A method of mass and/or ion mobility spectrometry comprising:

forming a plurality of initial groups of ions by repeatedly accumulating groups of ions;

forming one or more first groups of ions from one or more of said initial groups of ions;

forming one or more second groups of ions by extracting or separating ions from one or more of said initial groups of ions, wherein each of said one or more second groups of ions comprises fewer ions than each of said one or more first groups of ions;

analysing said one or more first groups of ions to generate one or more first data sets;

analysing said one or more second groups of ions to generate one or more second data sets; and determining whether said one or more first data sets comprise saturated and/or distorted data;

wherein when it is determined that said one or more first data sets comprise saturated and/or distorted data, then said method further comprises:

replacing said saturated and/or distorted data from said one or more first data sets with corresponding data from said one or more second data sets.

14. A method as claimed in claim 13, wherein forming each of said one or more second groups of ions comprises separating or isolating said second group of ions from an initial group of ions within an ion trap, trapping region or accumulation region.

15. A method as claimed in claim 13, wherein forming each of said one or more second groups of ions comprises passing to a downstream device only said second group of ions from an initial group of ions within an ion trap, trapping region or accumulation region.

16. A method as claimed in claim 13, wherein said method comprises forming said plurality of initial groups of ions by repeatedly accumulating ions for a fixed period of time.

17. A method as claimed in claim 13, wherein said step of forming a plurality of initial groups of ions comprises:

accumulating ions for a first period of time one or more times so as to form one or more first initial groups of ions; and accumulating ions for a second period of time one or more times so as to form one or more second initial groups of ions, wherein said second period of time is less that said first period of time.

18. A mass and/or ion mobility spectrometer comprising:

a device configured to form a plurality of initial groups of ions by repeatedly accumulating groups of ions;

a device configured to form one or more first groups of ions from one or more of the initial groups of ions;

a device configured to form one or more second groups of ions by extracting or separating ions from one or more of the initial groups of ions, wherein each of the one or more second groups of ions comprises fewer ions than each of the one or more first groups ions;

an analyser configured to analyse said one or more first groups of ions to generate one or more first data sets and to analyse said one or more second groups of ions to generate one or more second data sets; and a control system configured to determine whether said one or more first data sets comprise saturated and/or distorted data;

wherein said control system is further configured to, when it is determined that said one or more first data sets comprise saturated and/or distorted data:

replace said saturated and/or distorted data from said one or more first data sets with corresponding data from said one or more second data sets.

* * * * *